US010825577B2

(12) United States Patent
Uegaki et al.

(10) Patent No.: US 10,825,577 B2
(45) Date of Patent: Nov. 3, 2020

(54) COMMUNICATION CABLE HAVING SINGLE TWISTED PAIR OF INSULATED WIRES

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventors: Ryoma Uegaki, Mie (JP); Kinji Taguchi, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/716,146

(22) Filed: Dec. 16, 2019

(65) Prior Publication Data

US 2020/0118708 A1 Apr. 16, 2020

Related U.S. Application Data

(63) Continuation of application No. 15/565,526, filed as application No. PCT/JP2016/088127 on Dec. 21, 2016, now Pat. No. 10,553,329.

(30) Foreign Application Priority Data

Mar. 31, 2016 (JP) ..... 2016-071314
Dec. 2, 2016 (WO) ..... PCT/JP2016/085960

(51) Int. Cl.
*H01B 7/18* (2006.01)
*H01B 11/02* (2006.01)
(Continued)

(52) U.S. Cl.
CPC ..... *H01B 7/0216* (2013.01); *H01B 7/0291* (2013.01); *H01B 7/18* (2013.01);
(Continued)

(58) Field of Classification Search
CPC ..... H01B 7/0216; H01B 7/0291; H01B 7/18; H01B 11/02; H01B 11/08; H01B 11/12; H01B 11/002; H01B 11/10
(Continued)

(56) References Cited

U.S. PATENT DOCUMENTS 3,489,844 A * 1/1970 Motley ..... H01B 11/00 174/32
3,515,796 A 6/1970 Schoerner
(Continued)

FOREIGN PATENT DOCUMENTS

CN 1716463 A 6/2005
CN 102332337 A 1/2012
(Continued)

OTHER PUBLICATIONS

Electrical Properties of Plastics http://users.tm.net/lapoi nte/Plastics. htm (Year: 2001).*
(Continued)

*Primary Examiner* — Timothy J Thompson
*Assistant Examiner* — Michael F McAllister
(74) *Attorney, Agent, or Firm* — Reising Ethington, P.C.

(57) ABSTRACT

A communication cable that has a reduced diameter while ensuring a required magnitude of characteristic impedance. The communication cable contains a twisted pair that contains a pair of insulated wires, twisted with each other and a sheath covering the twisted pair. Each of the insulated wires, contains a conductor that has a tensile strength of 400 MPa or higher and an insulation coating that covers the conductor. The sheath is made of an insulating material
(Continued)

having a dielectric tangent of 0.0001 or higher. The communication cable 1 has a characteristic impedance of 100±10 Ω.

24 Claims, 4 Drawing Sheets

(51) Int. Cl.
*H01B 11/08* (2006.01)
*H01B 11/12* (2006.01)
*H01B 11/10* (2006.01)
*H01B 7/02* (2006.01)
*H01B 11/00* (2006.01)

(52) U.S. Cl.
CPC ..... *H01B 11/02* (2013.01); *H01B 11/08* (2013.01); *H01B 11/12* (2013.01); *H01B 11/002* (2013.01); *H01B 11/10* (2013.01)

(58) Field of Classification Search
USPC ..... 174/68.1
See application file for complete search history.

(56) References Cited

U.S. PATENT DOCUMENTS 3,522,112 A 7/1970 Mclain
RE27,854 E * 12/1973 Schoemer ..... H01B 11/002 174/113 R
4,506,235 A 3/1985 Mayer
4,559,200 A * 12/1985 Yamasaki ..... C22C 9/00 420/492
4,777,325 A 10/1988 Siwinski
4,873,393 A * 10/1989 Friesen ..... H01B 11/02 174/34
5,142,121 A 8/1992 Ezaki et al.
5,283,390 A * 2/1994 Hubis ..... H01B 11/10 156/51
5,327,513 A 7/1994 Nguyen et al.
5,597,981 A 1/1997 Hinoshita et al.
5,600,097 A 2/1997 Bleich et al.
5,606,151 A 2/1997 Siekierka et al.
5,619,016 A * 4/1997 Newmoyer ..... H01B 11/02 174/113 R
5,767,441 A * 6/1998 Brorein ..... H01B 7/0876 174/27
5,770,820 A * 6/1998 Nelson ..... C08K 5/0066 174/113 R
6,153,826 A * 11/2000 Kenny ..... H01B 11/02 174/113 R
6,194,663 B1 * 2/2001 Friesen ..... H01B 11/02 174/110 R
6,211,467 B1 * 4/2001 Berelsman ..... H01B 7/1895 174/113 C
6,222,129 B1 4/2001 Siekierka et al.
6,242,097 B1 6/2001 Nishiguchi
6,323,427 B1 * 11/2001 Rutledge ..... H01B 11/02 174/113 R
6,627,009 B1 9/2003 Matsui et al.
6,686,537 B1 * 2/2004 Gareis ..... H01B 7/292 174/110 R
6,815,611 B1 * 11/2004 Gareis ..... H01B 11/1025 174/36
7,507,909 B2 3/2009 Federighi
7,982,132 B2 * 7/2011 Hopkinson ..... H01B 11/002 174/113 R
8,431,825 B2 4/2013 Gareis
8,872,031 B2 * 10/2014 Hinoshita ..... H01B 7/29 174/113 R
8,981,216 B2 3/2015 Grant et al.
9,136,043 B2 * 9/2015 Brown ..... H01B 11/06
9,852,827 B2 12/2017 Koeppendoerfer et al.
10,170,220 B2 * 1/2019 Cornelison ..... H01B 11/1895
10,553,329 B2 2/2020 Uegaki et al.
2002/0044881 A1 * 4/2002 Breedis ..... C22C 9/00 420/496
2004/0112628 A1 6/2004 Brandi
2004/0166017 A1 * 8/2004 Caron ..... C22C 9/06 420/492
2004/0238086 A1 * 12/2004 Saleh ..... C22C 9/00 148/684
2006/0124343 A1 * 6/2006 Clark ..... H01B 11/04 174/113 R
2006/0169479 A1 8/2006 Dillon et al.
2007/0068696 A1 3/2007 Matsui
2008/0311328 A1 * 12/2008 Kimura ..... C08K 9/06 428/36.91
2010/0108349 A1 5/2010 Baeck
2010/0200267 A1 * 8/2010 Baeck ..... H01B 11/06 174/110 R
2011/0048764 A1 * 3/2011 Hira ..... H01B 11/10 174/105 R
2011/0315419 A1 12/2011 Grant et al.
2012/0298400 A1 * 11/2012 Hinoshita ..... H01B 7/29 174/113 R
2013/0092437 A1 * 4/2013 Yoshinaga ..... C22C 9/06 174/75 R
2013/0161855 A1 * 6/2013 Crouse ..... B29C 48/0013 264/103
2013/0264115 A1 * 10/2013 Kobayashi ..... H01B 7/00 174/72 A
2013/0333936 A1 12/2013 Gundel
2014/0262424 A1 9/2014 Liptak et al.
2014/0273594 A1 9/2014 Jones et al.
2015/0008011 A1 * 1/2015 Koeppendoerfer .... H01B 11/02 174/113 R
2015/0371726 A1 * 12/2015 Inoue ..... H01B 3/44 174/74 R
2016/0042842 A1 * 2/2016 Crouse ..... H01B 13/14 425/505
2016/0114742 A1 * 4/2016 Suguro ..... H02G 3/0462 174/72 A
2016/0133355 A1 5/2016 Glew et al.
2016/0254074 A1 9/2016 Kobayashi et al.
2016/0284437 A1 * 9/2016 Inoue ..... H01B 7/0036
2018/0174706 A1 6/2018 Shimosawa et al.

FOREIGN PATENT DOCUMENTS

CN 103025905 A 4/2013
CN 104700932 A 6/2015
CN 204792164 U 11/2015
DE 1783163 A1 7/1973
EP 1580767 A2 9/2005
EP 3103122 A1 12/2016
JP 6164834 A 4/1986
JP H6-60740 A 3/1994
JP H0757561 A 3/1995
JP 0850820 A 2/1996
JP H08507900 A 8/1996
JP H8-241631 A 9/1996
JP 0992050 A 4/1997
JP 2001148206 A 5/2001
JP 2001283649 A 10/2001
JP 2002510138 A 4/2002
JP 2003036739 A 2/2003
JP 2005032583 A 2/2005
JP 2008130347 A 6/2008
JP 2011096505 A 5/2011
JP 2012109128 A 6/2012
JP 2012146431 A 8/2012
JP 2013098127 A 5/2013
JP 201586452 A 5/2015
JP 2015130326 A 7/2015
JP 2015170431 A 9/2015
JP 2016157668 A 9/2016
KR 10-0708417 B 4/2007
KR 10-0825408 B 4/2008
KR 10-2014-0142671 A 12/2014

(56) References Cited

FOREIGN PATENT DOCUMENTS

| | | | |
|---|---|---|---|
| WO | 9950856 | | 10/1999 |
| WO | 2008127579 | A1 | 10/2008 |
| WO | WO2015093317 | A | 3/2017 |

OTHER PUBLICATIONS

Druflon International PTFE Insulated Equipment Wire Physical Data (Year: 2004).*
Druflon International Table of Sizes for PTFE Insulated Wires (Year: 2004).*
Chinese Office Action for Application No. 201680083363.3, dated Mar. 20, 2020; 7 pages.
English Translation of Chinese Office Action for Application No. 201680083363.3, dated Mar. 20, 2020; 8 pages.
Japanese Office Action for Application No. 2018-558063, dated Mar. 31, 2020; 4 pages.
English Translation of Japanese Office Action for Application No. 2018-558063, dated Mar. 31, 2020; 5 pages.
Office Action issued by the United States Patent and Trademark Office for U.S. Appl. No. 16/511,340, dated Jan. 17, 2020, 6 pages.
Chinese Office Action for Application No. 201680083363.3, dated Dec. 10, 2019; 4 pages.
Chinese Office Action for Application No. 201680083363.3, dated Dec. 10, 2019 (English); 5 pages.
English translation of Japanese Office Action for Application No. 2018-558063, dated Jan. 7, 2020, 6 pages.
Japanese Office Action for Application No. 2018-558063 dated Jan. 7, 2020; 4 pages.
English translation of Japanese Office Action for Application No. 2018-566086, dated Jan. 7, 2020, 7 pages.
Japanese Office Action for Application No. 2018-566086 dated Jan. 7, 2020; 5 pages.
Korean Office Action for Application No. 10-2019-7019783, dated Nov. 29, 2019; 6 pages.
Korean Office Action for Application No. 10-2019-7019783, dated Nov. 29, 2019 (English); 7 pages.
International Search Report for Application PCT/JP2016/088127 dated Jan. 31, 2017; 3 pages.
Chinese Office Action for Application No. CN201680082773.6, dated Aug. 13, 2019, 3 pages.
Chinese Office Action for Application No. CN201680082773.6, dated Aug. 13, 2019 (English), 6 pages.
Chinese Office Action for Application No. 201680082773.6 dated Mar. 12, 2019; 6 pages.
Chinese Office Action for Application No. 201680082773.6, dated Mar. 12, 2019 (English); 7 pages.
Office Action issued by the United States Patent and Trademark Office for U.S. Appl. No. 16/070,048, dated Jul. 30, 2019, 31 pages.
Chinese Office Action for Application No. 201680083365.2, dated May 20, 2019; 7 pages.
English Translation for Chinese Office Action for Application No. 201680083365.2 dated May 20, 2019; 7 pages.
Chinese Office Action for Application No. 201680083363.3, dated May 28, 2019; 5 pages.
Chinese Office Action for Application No. 201680083363.3, dated May 28, 2019 (English); 7 pages.
Office Action issued by the United States Patent and Trademark Office for U.S. Appl. No. 16/070,048 dated Mar. 4, 2019; 8 pages.
German Office action for Application 112016006142.0, dated Apr. 15, 2019; 9 pages.
German Office action for Application 112016006142.0, dated Apr. 15, 2019 (English); 5 pages.
Office Action issued by the United States Patent and Trademark Office for U.S. Appl. No. 16/070,057 dated Nov. 14, 2018; 12 pages.
Japanese Office Action for Application No. JP2018-508394, dated Nov. 13, 2018; 4 pages.
Japanese Office Action for Application No. JP2018-508394, dated Nov. 13, 2018 (English); 3 pages.
Korean Office Action for Application No. 10-2018-7022375, dated Dec. 13, 2018; 6 pages.
Korean Office Action for Application No. 10-2018-7022375, dated Dec. 13, 2018 (English); 6 pages.
Chinese Office Action for Application No. CN201680083365.2, dated Oct. 22, 2019, 4 pages.
English translation of Chinese Office Action for Application No. CN201680083365.2 dated Oct. 22, 2019, 4 pages.
Office Action issued by the United States Patent and Trademark Office for U.S. Appl. No. 16/070,048, dated Nov. 20, 2019, 12 pages.
Final Office Action issued by the USPTO for U.S. Appl. No. 16/070,048 dated Apr. 17, 2020.
Non-Final Office Action issued by the USPTO for U.S. Appl. No. 16/480,387 dated Mar. 6, 2020; 21 pages.
Office action issued by the China National Intellectual Property Administration for application CN 201780075209.6 dated Mar. 3, 2020; 6 pages.
English Translation of the Office action issued by the China National Intellectual Property Administration for application CN 201780075209.6 dated Mar. 3, 2020; 6 pages.
Office action issued by the China National Intellectual Property Administration for application CN 201880007236.4 dated Mar. 10, 2020; 11 pages.
English Translation of the Office action issued by the China National Intellectual Property Administration for application CN 201880007236.4 dated Mar. 10, 2020; 13 pages.
Korean Office Action for Application No. 10-2019-7019783, dated May 26, 2020; 4 pages.
English Translation of Korean Office Action for Application No. 10-2019-7019783, dated May 26, 2020; 5 pages.
Office Action for U.S. Appl. No. 16/472,304 dated Jun. 26, 2020 (10 pages).

* cited by examiner

COMMUNICATION CABLE HAVING SINGLE TWISTED PAIR OF INSULATED WIRES

CROSS REFERENCE TO RELATED APPLICATIONS

This application is a Continuation of U.S. Ser. No. 15/565,526, filed on Oct. 10, 2017, and claims the priority of Japanese patent application JP2016-071314 filed on Mar. 31, 2016, and PCT/JP2016/085960 filed on Dec. 2, 2016, the entire contents of which are incorporated herein.

TECHNICAL FIELD

The present invention relates to a communication cable, and more specifically to a communication cable that can be used for high-speed communication such as in an automobile.

BACKGROUND ART

Demand for high-speed communication is increasing in fields such as of automobiles. Transmission characteristics of a cable used for high-speed communication such as a characteristic impedance thereof have to be controlled strictly. For example, a characteristic impedance of a cable used for Ethernet communication has to be controlled to be 100±10Ω.

A characteristic impedance of a communication cable depends on specific features thereof such as a diameter of a conductor and type and thickness of an insulation coating. For example, Patent Document 1 (JP2005-32583A) discloses a shielded communication cable containing a twisted pair that contains a pair of insulated cores twisted with each other, each insulated core containing a conductor and an insulator covering the conductor. The cable further contains a metal-foil shield covering the twisted pair, a grounding wire electrically continuous with the shield, and a sheath that covers the twisted pair, the grounding wire, and the shield together. The cable has a characteristic impedance of 100±10Ω. The insulated cores used in Patent Document 1 have a conductor diameter of 0.55 mm, and the insulator covering the conductor has a thickness of 0.35 to 0.45 mm.

SUMMARY

There exists a great demand for reduction of a diameter of a communication cable installed such as in an automobile. To satisfy the demand, the size of the cable has to be reduced with satisfying required transmission characteristics including characteristic impedance. A possible method for reducing the diameter of a communication cable containing a twisted pair is to make insulation coatings of insulated wires constituting the twisted pair thinner. According to investigation by the present inventors, however, if the thickness of the insulator in the communication cable disclosed in Patent Document 1 is made smaller than 0.35 mm, the characteristic impedance falls below 90Ω. This is out of the range of 100±10Ω, which is required for Ethernet communication.

An object of the present design is to provide a communication cable that has a reduced diameter while ensuring a required magnitude of characteristic impedance.

To achieve the object and in accordance with the purpose of the present design, a communication cable may contain a twisted pair and a sheath, where the twisted pair contains a pair of insulated wires twisted with each other, each of the insulated wire containing a conductor that has a tensile strength of 400 MPa or higher and an insulation coating that covers the conductor, the sheath is made of an insulating material having a dielectric tangent of 0.0001 or higher, and covers the twisted pair, and the communication cable has a characteristic impedance of 100±10Ω.

It is preferable that the dielectric tangent of the sheath is 0.0001 or higher. It is preferable that the dielectric tangent of the sheath should be higher than a dielectric tangent of the insulation coating of each of the insulated wires.

It is preferable that the communication cable should contain a gap between the sheath and the insulated wires constituting the twisted pair. It is preferable that the gap should occupy 8% or more of an area of a region surrounded by an outer surface of the sheath in a section of the communication cable crossing an axis of the cable. It is preferable that the gap should occupy 30% or less of an area of a region surrounded by an outer surface of the sheath in a section of the communication cable crossing an axis of the cable.

It is preferable that each of the insulated wires should have a conductor cross-sectional area smaller than 0.22 $mm^2$. It is preferable that the insulation coating of each of the insulated wires should have a thickness of 0.30 mm or smaller. It is preferable that each of the insulated wires should have an outer diameter of 1.05 mm or smaller. It is preferable that the conductor of each of the insulated wires should have a breaking elongation of 7% or higher.

It is preferable that the twisted pair should have a twist pitch of 45 times of an outer diameter of each of the insulated wires or smaller. It is preferable that the sheath should have an adhesion strength of 4 N or higher to the insulated wires.

In the above-described communication cable, since the conductor of each of the insulated wires constituting the twisted pair has the high tensile strength of 400 MPa or higher, the diameter of the conductor can be reduced while sufficient strength required for an electric wire is ensured. Thus, the distance between the two conductors constituting the twisted pair is reduced, whereby the characteristic impedance of the communication cable can be increased. As a result, the characteristic impedance of the communication cable can be ensured in the range of 100±10Ω, without falling below the range, even when the insulation coating of each of the insulated wires is made thin to reduce the diameter of the communication cable.

Further, since the sheath has the dielectric tangent of 0.0001 or higher, a coupling between the ground potential around the communication cable and the twisted pair can effectively be attenuated by dielectric loss of the sheath due to the high dielectric tangent of the sheath. As a result, a high value of transmission mode conversion, such as 46 dB or higher, can be achieved.

When the dielectric tangent of the sheath is higher than the dielectric tangent of the insulation coating of each of the insulated wires, both reduction of noise and suppression of signal attenuation is realized for the communication cable.

When the communication cable contains the gap between the sheath and the insulated wires constituting the twisted pair, there exists a layer of air around the twisted pair, whereby the characteristic impedance of the communication cable can be higher than in the case where the sheath fills the gap. Thus, a sufficiently high characteristic impedance can be ensured well for the communication cable even when the thickness of the insulation coating of each of the insulated wires is reduced. Reduction of the thickness of the insulation coating would contribute to reduction of the entire outer diameter of the communication cable.

When the gap occupies 8% or more of the area of the region surrounded by the outer surface of the sheath in the section of the communication cable crossing the axis of the cable, the diameter of the communication cable is more effectively reduced by increase of the characteristic impedance thereof.

When the gap occupies 30% or less of the area of the region surrounded by the outer surface of the sheath in the section of the communication cable crossing the axis of the cable, the gap is not too large to fix the position of the twisted pair steadily in the space inside the sheath. Thus, fluctuations or temporal changes in transmission characteristics of the communication cable including the characteristic impedance are suppressed well.

When each of the insulated wires has the conductor cross-sectional area smaller than 0.22 $mm^2$, the characteristic impedance of the communication cable is increased due to the effect of reduction of the distance between the two insulated wires constituting the twisted pair, whereby reduction of the diameter of the communication cable by reduction of the thickness of the insulation coating is facilitated while ensuring the required characteristic impedance. Further, the small diameter of each of the conductor itself has the effect of reducing the diameter of the communication cable.

When the insulation coating of each of the insulated wires has the thickness of 0.30 mm or smaller, the diameter of each of the insulated wires is sufficiently small, whereby the diameter of the whole communication cable can effectively be made small.

Also when each of the insulated wires has the outer diameter of 1.05 mm or smaller, the diameter of the entire communication cable can effectively be made small.

When the conductor of each of the insulated wires has the breaking elongation of 7% or higher, the conductor has a high impact resistance, whereby the conductor well resists the impact applied to the conductor when the communication cable is processed into a wiring harness or when the wiring harness is installed.

When the twisted pair has the twist pitch of 45 times of the outer diameter of each of the insulated wires or smaller, the twist structure of the twisted pair is hard to be loosened, whereby fluctuations or temporal changes in the transmission characteristics of the communication cable including the characteristic impedance that can be caused by loosening of the twist structure are suppressed well.

When the sheath has the adhesion strength of 4 N or higher to the insulated wires, variation in the position of the twisted pair inside the sheath or loosening of the twist structure thereof hardly occurs. Thus, fluctuations or temporal changes in transmission characteristics of the communication cable including the characteristic impedance that may be caused by the variation or loosening are suppressed well.

BRIEF DESCRIPTION OF DRAWINGS

FIG. 3A shows a first twist structure (without wrenching) while FIG. 3B shows a second twist structure (with wrenching). In each figure, a dotted line serves as a guide to show portions along the axis of an insulated wire that are located in an identical position with respect to the axis of the insulated wire.

DESCRIPTION OF EMBODIMENTS

A detailed description of a communication cable according to a preferred embodiment will now be provided. In the present specification, every material property that depends on measuring frequency and/or measuring condition, such as dielectric tangent or dielectric constant, is defined at a frequency at which the communication cable is used, for example, in the range of 1 to 50 MHz, and is measured in air at room temperature unless otherwise specified.

Figure 1:
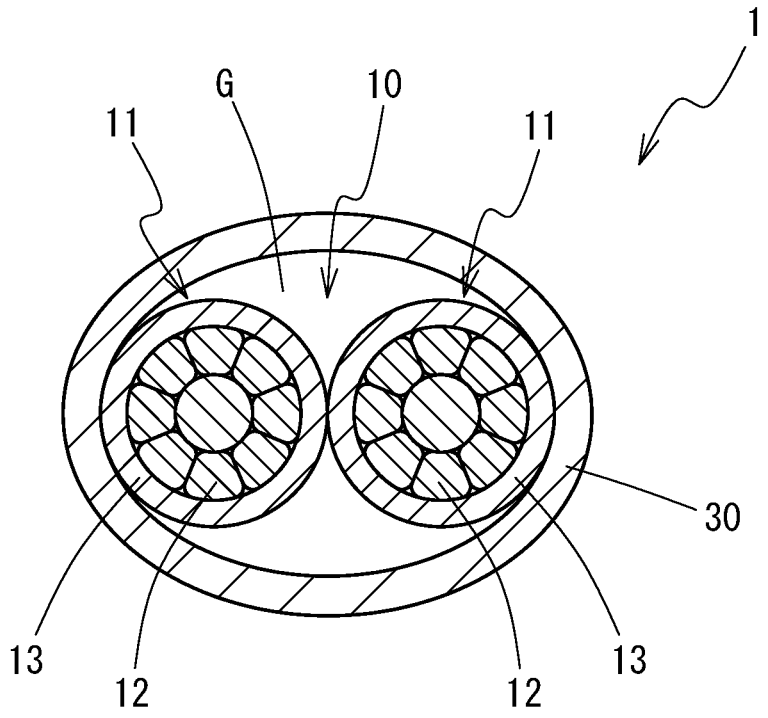
FIG. 1 is a cross-sectional view showing a communication cable according to a preferred embodiment that has a sheath taking the form of a loose jacket.

FIG. 1 shows a cross-sectional view of the communication cable 1 according to the embodiment of the present design.

The communication cable 1 contains a twisted pair 10 that contains a pair of insulated wires 11, 11 twisted with each other. Each of the insulated wires 11 contains a conductor 12 and an insulation coating 13 that covers the conductor 12 on the outer surface of the conductor 12. Further, the communication cable 1 contains a sheath 30 that is made of an insulating material and covers the whole twisted pair 10 on the outer periphery of the twisted pair 10.

The communication cable 1 has a characteristic impedance of 100±10Ω. A characteristic impedance of 100±10Ω is required for a cable used for Ethernet communication. Having the characteristic impedance, the communication cable 1 can be used suitably for high-speed communication such as in an automobile.

(1) Configuration of Insulated Wires

The conductors 12 of the insulated wires 11 constituting the twisted pair 10 are metal wires having a tensile strength of 400 MPa or higher. Specific examples of the metal wires include copper alloy wires containing Fe and Ti and copper alloy wires containing Fe, P, and Sn, which are illustrated later. The tensile strength of the conductors 12 is preferably 440 MPa or higher, and more preferably 480 MPa or higher.

Since the conductors 12 have the tensile strength of 400 MPa or higher, 440 MPa or higher, or 480 MPa or higher, the conductors can maintain a tensile strength that is required for electric wires even when the diameter of the conductors 12 is reduced. When the diameter of the conductors 12 is reduced, the distance between the two conductors 12, 12 constituting the twisted pair 10 (i.e., the length of the line connecting the centers of the conductors 12, 12 with each other) is reduced, whereby the characteristic impedance of the communication cable 1 is increased. For example, the dimeter of the conductors 12 can be as small as providing a conductor cross-sectional area smaller than 0.22 $mm^2$, and more preferably a conductor cross-sectional area of 0.15 $mm^2$ or smaller, or 0.13 $mm^2$ or smaller. The outer diameter of the conductors 12 can be 0.55 mm or smaller, more preferably 0.50 mm or smaller, and still more preferably 0.45 mm or smaller. If the diameter of the conductors 12 is too small, however, the conductors 12 can hardly have sufficient strength, and the characteristic impedance of the communication cable 1 may be too high. Thus, the conductor cross-sectional area of the conductors 12 is preferably 0.08 $mm^2$ or larger.

When the conductors 12 have a small conductor cross-sectional area smaller than 0.22 $mm^2$, characteristic impedance of 100±10Ω can be ensured well for the communication cable 1 even if the thickness of the insulation coatings 13 covering the conductors 12 are reduced, for example, to 0.30 mm or smaller. Conventional copper electric wires are hard to be used with a conductor cross-sectional area smaller than 0.22 $mm^2$ because the wires have lower tensile strengths.

It is preferable that the conductors 12 should have a breaking elongation of 7% or higher. Generally, a conductor having a high tensile strength has low toughness, and thus exhibits low impact resistance when a force is applied to the conductor rapidly. If the above-described conductors 12 having the high tensile strength of 400 MPa or higher have a breaking elongation of 7% or higher, however, the conductors 12 can exhibit excellent resistance to impacts applied to the conductors 12 when the communication cable 1 is processed to a wiring harness or when the wiring harness is installed. The breaking elongation of the conductors 12 is more preferably 10% or higher.

The conductors 12 may each consist of single wires; however, it is preferable in view of having high flexibility that the conductors 12 should consist of strand wires each containing a plurality of (e.g., seven) elemental wires stranded with each other. In this case, the conductors 12 may be compressed strands formed by compression of strand wires after stranding of the elemental wires. The outer dimeter of the conductors 12 can be reduced by the compression. Further, when the conductors 12 are strand wires, the conductors 12 may consist of single type of elemental wires or of two or more types of elemental wires as long as the whole conductors 12 each have the tensile strength of 400 MPa or higher. Example of the conductors 12 consisting of two or more types of elemental wires include conductors that contain below-described copper alloy wires containing Fe and Ti, or ones containing Fe, P, and Sn, and further contain elemental wires made of a metal material other than a copper alloy such as SUS.

When the conductors 12 have a lower conductor resistance, the diameter and weight of the conductors 12 can more effectively be reduced. This is because conductors 12 having lower conductor resistance have high conductivity sufficient for signal transmission even when the conductors 12 have a smaller diameter. For example, the conductor resistance is preferably 210 mΩ/m or lower. On the other hand, when the conductors 12 have a higher conductor resistance, the communication cable 1 has higher mode conversion characteristics. For example, the conductor resistance is preferably 150 mΩ/m or higher.

The insulation coatings 13 of the insulated wires 11 may be made of any kind of polymer material. It is preferable that the insulation coatings 13 should have a relative dielectric constant of 4.0 or smaller in view of ensuring the required high characteristic impedance. Examples of the polymer material having the relative dielectric constant include polyolefin such as polyethylene and polypropylene, polyvinyl chloride, polystyrene, polytetrafluoroethylene, and polyphenylenesulfide. Further, the insulation coatings 13 may contain additives such as a flame retardant in addition to the polymer material.

It is preferable that the polymer material contained in the insulation coatings 13 should have a low molecular polarity, in view of making the dielectric constant of the insulation coatings 13 small, and particularly in view of suppressing excessive rise of the dielectric constant even when the insulation coatings 13 are subjected to a high temperature such as in an automobile. For example, polyolefin, which is a non-polar polymer material, is especially preferable among the polymer materials listed above.

It is more preferable that the insulation coatings 13 should have a lower dielectric tangent in view of suppressing attenuation of signals in the twisted pair 10 better and reducing the diameter and weight of the insulated wires 11. The dielectric tangent is preferably 0.001 or lower, for example. Further, as described in detail below, the material of the insulation coatings 13 preferably has a dielectric tangent not higher than the dielectric tangent of the material of the sheath 30, and more preferably has a dielectric tangent lower than the dielectric tangent of the material of sheath 30.

The polymer material contained in the insulation coatings 13 may or may not be foamed. It is preferable that the material should be foamed in view of lowering the dielectric constant of the insulation coatings 13 and thus reducing the diameter of the insulated wires 11. On the other hand, it is preferable that the material should not be formed in view of stabilizing the transmission characteristics of the communication cable 1 and simplifying the manufacturing process of the insulation coatings 13.

The characteristic impedance of the communication cable 1 is increased by reduction of the diameter of the conductors 12 and consequent closer location of the two conductors 12, 12. As a result, the thickness of the insulation coatings 13 that is required to ensure the required characteristic impedance can be reduced. For example, the thickness of the insulation coatings 13 is preferably 0.30 mm or smaller, more preferably 0.25 mm or smaller, and still more preferably 0.20 mm or smaller. If the insulation coatings 13 are too thin, however, it may be hard to ensure the required high characteristic impedance. Thus, the thickness of the insulation coatings 13 is preferably larger than 0.15 mm.

The whole diameter of the insulated wires 11 is reduced by reduction of the diameter of the conductors 12 and the thickness of the insulation coatings 13. For example, the outer dimeter of the insulated wires 11 can be 1.05 mm or smaller, more preferably 0.95 mm or smaller, and still more preferably 0.85 mm or smaller. Reduction of the diameter of the insulated wires 11 serves to reduce the diameter of the communication cable 1 as a whole.

In the insulated wires 11, it is preferable that the uniformity in the thickness of the insulation coatings 13 (i.e., the insulation thickness) around the conductors 12 should be higher. In other words, it is preferable that thickness deviation of the insulation coatings 13 should be smaller. In that case, eccentricity of the conductors 12 would be smaller, and thus the symmetry of the positions of conductors 12 within the twisted pair 10 would be higher. As a result, the communication cable 1 would have higher transmission characteristics, and more particularly higher mode conversion characteristics. For example, it is preferable that the eccentricity ratio of the insulated wires 11 should be 65% or higher, and more preferably 75% or higher. Here, the eccentricity ratio is calculated as [smallest insulation thickness]/[largest insulation thickness]×100%.

The twisted pair 10 may be formed by twisting of the two insulated wires 11 with each other. The twist pitch may be set appropriately depending such as on the outer diameter of the insulated wires 11; however, the twist pitch is preferably 60 times of the outer diameters of the insulated wires 11 or smaller, more preferably 45 times or smaller, and still more preferably 30 times or smaller, to effectively suppress loosening of the twist structure. Loosening of the twist structure may lead to fluctuations or temporal changes in transmission characteristics of the communication cable 1 including the characteristic impedance. In particular, when the sheath 30 takes the form of a loose jacket as described below, the sheath 30 may be more difficult to suppress loosening of the twist structure caused by force applied to the twisted pair 10 than in the case where the sheath 30 takes the form of a filled jacket since there exists a gap G between the loose jacket sheath 30 and the twisted pair 10. Loosening of the twist structure, however, can be effectively suppressed by adopting the above-described preferable twist pitch even when the sheath 30 takes the form of the loose jacket. By suppression of the loosening of the twist structure, the distance (i.e., line spacing) between the two insulated wires 11 constituting the twisted pair 10 can be kept small, for example, substantially at 0 mm in every portion within the pitch, whereby stable transmission characteristics can be achieved. On the other hand, if the twist pitch of the twisted pair 10 is too small, the productivity of the twisted pair 10 may be low, and production cost of the twisted pair 10 may be high. Thus, the twist pitch is preferably 8 times of the outer diameter of the insulated wires 11 or larger, more preferably 12 times or larger, and still more preferably 15 times or larger.

Figure 3A:
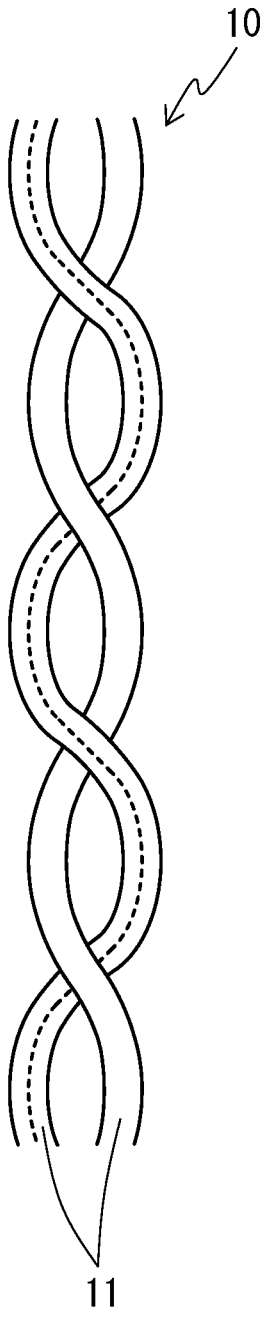
FIGS. 3A and 3B are explanatory drawings showing two types of twist structures.

Examples of the twist structure of the two insulated wires 11 in the twisted pair 10 include the two following structures: in a first twist structure, as shown in FIG. 3A, each of the insulated wires 11 is not wrenched about its twist axis, and portions of each of the insulated wires 11 with respect to its own axis do not change their relative up-down or left-right orientations along the twist axis. In other words, portions located in an identical position with respect to the axis of each of the insulated wires 11 face one direction, such as an upward direction, throughout the twist structure. In the figure, the dotted line shows portions along the axis of one of the insulated wires 11 that are located in an identical position with respect to the axis of the insulated wire 11. Since the insulated wire 11 is not wrenched, the dotted line is visible on the front side of the figure, at the center of the wire 11, throughout the twist structure. It should be noted that FIGS. 3A and 3B show the twisted pair 10 in a state where the twist is loosened for easier recognition of the twist structure.

Figure 3B:
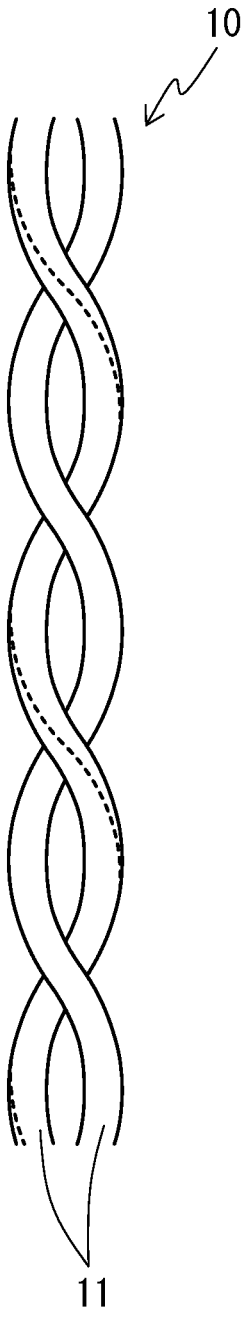

In a second twist structure, as shown in FIG. 3B, each of the insulated wires 11 is wrenched about its twist axis, and portions of each of the insulated wires 11 with respect to its own axis change their relative up-down and left-right orientations along the twist axis. In other words, portions located in an identical position with respect to the axis of each of the insulated wires 11 face various directions, such as upward, downward, leftward, and rightward, throughout the twist structure. In the figure, the dotted line shows portions along the axis of one of the insulated wires 11 that are located in an identical position with respect to the axis of the insulated wire 11. Since the insulated wire 11 is wrenched, the dotted line is visible on the front side of the figure only in a part of every pitch of the twist structure. The dotted line continuously changes its position in the front and back direction in every pitch of the twist structure.

The first twist structure is more preferable than the second one. This is because variation in the line spacing between the two insulated wires 11 in every pitch is smaller in the first twist structure. Particularly, in the communication cable 1 according to the present embodiment, variation in the line spacing may occur easily due to the influence of the wrenching of the insulated wires 11 since the insulated wires 11 have a reduce diameter; however, the influence of the wrenching can be suppressed better in the first twist structure. Variation in the line spacing may destabilize the transmission characteristics of the communication cable 1.

It is preferable that the difference between the lengths of the two insulted wires 11 constituting the twisted pair 10 (i.e., line length difference) should be smaller. In that case, the symmetry of the two insulated wires 11 in the twisted pair 10 can be higher, and thus the transmission characteristics of the twisted pair 10, and more particularly its mode conversion characteristics, can be improved. For example, when the line length difference in 1 m of the twisted pair 10 is 5 mm or smaller, and more preferably 3 mm or smaller, the influence of the line length difference can be suppressed well.

In the twisted pair 10, the two insulated wires 11 may simply be twisted to each other, or the insulation coatings 13 of the insulated wires 11 may further be fused to each other entirely or partially in the longitudinal direction of the cable 1. Balance of the two insulated wires 11 is improved by the fusion, and thus the transmission characteristics of the communication cable 1 is improved.

The sheath 30 plays roles of protecting the twisted pair 10 and maintaining the twist structure of the twisted pair 10. Particularly when the communication cable 1 is used in an automobile, protection of the communication cable 1 from the influence of water is required. In this case, the sheath 30 also plays a role of preventing the influence of water on transmission characteristics of the communication cable 1 including the characteristic impedance when water is brought into contact with the communication cable 1. Sheath 30 is made of an insulating material having a dielectric tangent of 0.0001 or higher.

In the embodiment shown in FIG. 1, the sheath 30 takes the form of a loose jacket. The loose jacket takes the shape of a hollow tube, and accommodates the twisted pair 10 in the space inside the hollow tube. Sheath 30 is in contact with the insulated wires 11 constituting the twisted pair 10 in some portions along the peripheral direction of the inner surface of the sheaths 30 while a gap G exists between the sheath 30 and the insulated wires 11 in the other portions. There is a layer of air in the gap G. Details of the configuration of the sheath 30 will be illustrated later.

For evaluation of the state of the communication cable 1 in the cross section thereof with regard to, for example, whether there is a gap G between the sheath 30 and the insulated wires 11 or how large the gap G is, as stated below, it is preferable that the whole communication cable 1 should be embedded in a resin such as an acrylic resin, and is fixed in the resin in a state where the space inside the sheath 30 is filled with the resin. Then, the cable 1 should be cut. In this procedure, the cutting operation to obtain the cross section hardly impairs the precision of the evaluation by deforming the sheath 30 or the twisted pair 10. In the obtained cross section, an area filled with the resin corresponds to an area where a gap G originally occupied.

In the communication cable 1 according to the present embodiment, the sheath 30 directly surrounds the twisted pair 10, without having a shield made of a conductive material surrounding the twisted pair 10 inside the sheath 30, in contrast to the case disclosed in Patent Document 1. The shield would play roles of shielding the twisted pair 10 from outside noises and stopping noises released from the twisted pair 10 to the outside; however, the communication cable 1 according to the present embodiment does not have the shield because the cable 1 is expected to be used under conditions where the influence of noises is not serious. It is preferable that the communication cable 1 according to the present embodiment should not have the shield or any other member between the sheath 30 and the twisted pair 10 in view of effectively achieving reduction of the diameter and cost of the cable 1 by simplification of its configuration, but the sheath 30 should directly surround the twisted pair 10 via the gap G.

Nevertheless, the communication cable 1 may have a shield made of a conductive material surrounding the twisted pair 10 inside the sheath 30, for example, when the influence of the noises has to be highly reduced. When the cable 1 has the shield, discussions on presence and size of the gap G between the sheath 30 and the twisted pair 10 and adhesion of the sheath 30 to the insulated wires 11 are not compatible with the presence of the shield. Thus, such discussions presented in the following description should be omitted in the case.

As described above, since the conductors 12 of the insulated wires 11 constituting the twisted pair 10 of the communication cable 1 have a tensile strength of 400 MPa or higher, sufficient strength for the use in an automobile can be ensured well for the communication cable 1 even when the diameter of the conductors 12 is reduced. When the conductors 12 have a reduced diameter, the distance between the two conductors 12, 12 in the twisted pair 10 is reduced. When the distance between the two conductors 12, 12 is reduced, the characteristic impedance of the communication cable 1 is increased. When the insulated wires 11 constituting the twisted pair 10 have thinner insulation coatings 13, the communication cable 1 has a lower characteristic impedance; however, in the present embodiment, the reduced distance between the conductors 12, 12 realized by their reduced diameter can ensure the characteristic impedance of 100±10Ω for the communication cable 1 even with a small thickness of the insulation coatings 13, for example, of 0.30 mm or smaller.

Making the insulation coatings 13 of the insulated wires 11 thinner leads to reduction of the diameter (i.e. finished diameter) of the communication cable 1 as a whole. For example, the diameter of the communication cable 1 can be reduced to 2.9 mm or smaller, and more preferably to 2.5 mm or smaller. The communication cable 1, having the reduced diameter while ensuring the required characteristic impedance, can be suitably used for high-speed communication in a limited space such as in an automobile.

Reduction of the diameter of the conductors 12 and the thickness of the insulation coatings 13 in the insulated wires 11 is effective for reduction of the weight of the communication cable 1 as well as reduction of the diameter of the cable 1. When the cable 1 is used for communication in an automobile, reduction of the weight of the communication cable 1 leads to reduction of the weight of the whole automobile and thereby to improvement of fuel efficiency of the automobile.

Further, the communication cable 1 has a high breaking strength since the conductors 12 contained in the insulated wires 11 have the tensile strength of 400 MPa or higher. The breaking strength can be increased, for example, to 100 N or higher, and more preferably to 140 N or higher. Having the high breaking strength, the communication cable 1 can exhibit a high holding strength at a terminal end thereof with respect to a component such as a terminal fitting. In other words, the communication cable 1 hardly breaks at a terminal position thereof where a component such as a terminal fitting is attached.

It is more preferable that a communication cable should have transmission characteristics, such as transmission loss (IL), reflection loss (RL), transmission mode conversion (LCTL), and reflection mode conversion (LCL), that satisfy required levels, as well as a sufficiently high characteristic impedance such as 100±10Ω. Particularly, the communication cable 1 according to the present embodiment can satisfy the criteria IL≤0.68 dB/m (66 MHz), RL≥20.0 dB (20 MHz), LCTL≥46.0 dB (50 MHz), and LCL≥46.0 dB (50 MHz) even when the thickness of the insulation coatings 13 of the insulated wires 11 is smaller than 0.25 mm and is further 0.15 mm or smeller since the sheath 30 takes the form of the loose jacket.

The sheath 30 contains a polymer material as a main component. The polymer material contained in the sheath 30 is not limited specifically. Specific examples of the polymer material include polyolefin such as polyethylene and polypropylene, polyvinyl chloride, polystyrene, polytetrafluoroethylene, and polyphenylenesulfide. Further, the sheath 30 may contain additives such as a flame retardant in addition to the polymer material as necessary.

As described above, the sheath 30 in the present embodiment is made of an insulating material having a dielectric tangent of 0.0001 or higher. When the material of the sheath 30 has a higher dielectric tangent, the dielectric loss in the sheath 30 is higher, and the common-mode noises originating from coupling between the twisted pair 10 and the ground potential outside the communication cable 1 can be attenuated better. The mode conversion characteristics of the communication cable 1 are thereby improved. Here, the mode conversion characteristics denote the transmission mode conversion (LCTL) and reflection mode conversion (LCL), particularly the former. The mode conversion characteristics serve as indicators of degree of conversion of a signal transmitted in the communication cable 1 between a differential mode and a common mode. Larger (absolute) values of the mode conversion characteristics indicate more suppressed conversion between the modes.

The sheath 30 having the dielectric tangent of 0.0001 or higher helps the communication cable 1 to have excellent mode conversion characteristics, such as LCTL≥46.0 dB (50 MHz) and LCL≥46.0 dB (50 MHz). If the dielectric tangent is 0.0006 or higher, the mode conversion characteristics may be improved better. There often exists a member serving as a ground potential in proximity to the communication cable 1 such as a vehicle body when the cable 1 is used in an automobile. In that case, attenuation of noises with the use of the sheath 30 having the high dielectric tangent has great significance.

On the other hand, if the dielectric tangent of the material of the sheath 30 is too high, attenuation of the differential-mode signal transmitted over the twisted pair 10 may be too high, and a communication trouble may thereby be caused. Influence of attenuation of the signal can be suppressed well, when the dielectric tangent of the sheath 30 is 0.08 or lower, and more preferably 0.01 or lower, for example.

The dielectric tangent of the sheath 30 may be adjusted depending on the types of the polymer material and additives such as a flame retardant contained in the sheath 30, and the amounts of the additives. For example, when a polymer material having a high molecular polarity is contained in the sheath 30, the dielectric tangent of the sheath 30 can be increased. This is because a polymer material having a high molecular polarity and a consequent large dielectric constant usually has a high dielectric tangent. Further, also when an additive having a high polarity is contained in the sheath 30, the dielectric tangent of the sheath 30 can be high. Further, when the amount of the additive is increased, the dielectric tangent can be still higher.

When reduction of the whole diameter of this kind of communication cable 1 is intended to be achieved by reduction of the diameter of the insulated wires 11 and the thickness of the sheath 30, it may be difficult to ensure a required characteristic impedance, such as 100±10Ω, in some cases. Instead, the characteristic impedance may be increased by reduction of the effective dielectric constant of the communication cable 1, which is defined by Formula (1) below. For the reason, it is preferable that the sheath 30 should contain a polymer material having a low molecular polarity and thus providing a small dielectric constant.

[Formula 1]

$$Z_0 = \frac{\eta_0}{\pi\sqrt{\varepsilon_{eff}}}\cosh^{-1}\left(\frac{D}{d}\right), \quad (1)$$

where $\varepsilon_{eff}$ is an effective dielectric constant, d is a diameter of conductors, D is an outer diameter of the cable, and $\eta_0$ is a constant.

Further, it is preferable that the polymer material of the sheath 30 should have a lower molecular polarity also for the reason that the low molecular polarity contributes to avoiding great increase of the dielectric constant of the sheath 30 at a high temperature and consequent decrease of the characteristic impedance of the communication cable 1. A non-polar polymer material is particularly preferably used as a polymer material having a low molecular polarity. Among the polymer materials listed above, polyolefin is a non-polar polymer material.

Thus, it is desired that the sheath 30 should have a high dielectric tangent, which tends to be high when a molecular polarity of a polymer material is high, while it is simultaneously desired that the polymer material contained in the sheath 30 should have a low molecular polarity for other reasons. Hence, a sheath 30 having a high dielectric tangent as a whole material may be obtained by addition of a polar additive, which increases the dielectric tangent of the whole material, to a polymer material having no or low molecular polarity such as polyolefin.

Further, it is preferable that the material of the sheath 30 should have a dielectric tangent not lower than the dielectric tangent of the material of the insulation coatings 13 of the insulated wires 11, and more preferably has a dielectric tangent higher than the dielectric tangent of the insulation coatings 13. This is because a higher dielectric tangent is preferable for the sheath 30 in view of improvement of the mode conversion characteristics while a lower dielectric tangent is preferable for the insulation coatings 13 in view of suppression of attenuation of the differential signal transmitted over the twisted pair 10. For example, the dielectric tangent of the sheath 30 is preferably 1.5 times or more, more preferably 2 times or more, and still more preferably 5 times or more of the dielectric tangent of the insulation coatings 13.

The polymer material contained in the sheath 30 may or may not be foamed. It is preferable that the material should be foamed in view of decreasing the dielectric constant of the sheath 30 by the presence of air in the foamed structure and thus increasing the characteristic impedance of the communication cable 1. On the other hand, it is preferable that the material should not be foamed in view of stabilizing the transmission characteristics of the communication cable 1 by suppression of variation in the transmission characteristics depending on the degree of foaming. Further, with respect to the manufacturing process of the sheath 30, the sheath 30 with foamed can be manufactured more simply by omission of the foaming process. On the other hand, the sheath 30 without foamed can be manufactured more simply in view of achieving a small dielectric constant even with no gap G (i.e., even when the sheath 30 takes the form of a filled jacket as described below), or even with a small gap G.

The polymer material contained in the sheath 30 and the one contained in the insulation coatings 13 may be identical or different mutually. They are preferably identical in view of simplification of the configuration and manufacturing process of the whole communication cable 1. On the other hand, they are preferably different in view of high degree of freedom in selecting properties such as dielectric constants for both the sheath 30 and the insulation coatings 13 independently.

Figure 2:
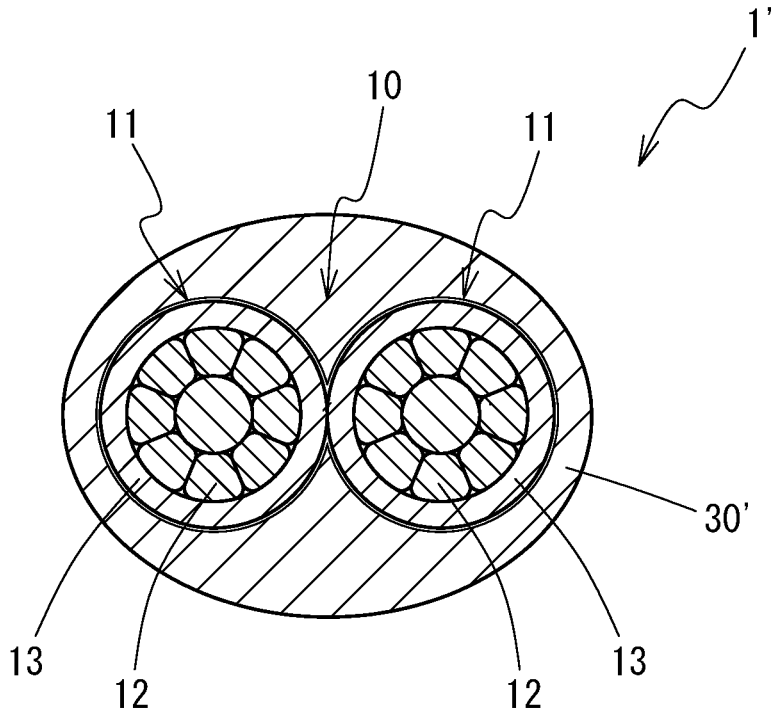
FIG. 2 is a cross-sectional view showing a communication cable that has a sheath taking the form of a filled jacket.

As described above, the communication cable 1 according to the present embodiment has a sheath 30 taking the form of a loose jacket, and has a gap G between the sheath 30 and the insulated wires 11 constituting the twisted pair 10; however, the shape of the sheath 30 is not limited specifically. It is not mandatory for the cable 1 to have a loose jacket sheath 30 or to have a gap G. In other words, a communication cable 1' that has a sheath 30' taking the form of a filled jacket is also available, as shown in FIG. 2. In this case, the sheath 30' is in contact with the insulated wires 11 constituting the twisted pair 10, or fills the space extending to close proximity of the insulated wires 11. The cable 1' has substantially no gap between the sheath 30' and the insulated wires 11 except a gap inevitably formed in the manufacturing process.

The sheath 30 takes more preferably the form of the loose jacket than the form of the filled jacket in view of reduction of the diameter of the communication cable 1 while ensuring the characteristic impedance at a required high level. This is because the characteristic impedance of the communication cable 1 is higher when the twisted pair 10 is surrounded by a material having a smaller dielectric constant (see Formula (1)). The loose jacket configuration where a layer of air surrounds the twisted pair 10 provides a higher characteristic impedance than the filled jacket configuration where a dielectric material exists immediately outside the twisted pair 10. Thus, the loose jacket configuration can ensure the characteristic impedance of 100±10Ω with thinner insulation coatings 13 of the insulated wires 11 than the filled jacket configuration. The thinner insulation coatings 13 contribute to reduction of the dimeter of the insulated wires 11 and that of the whole communication cable 1.

Specifically, when the conductors 12 of the insulated wires 11 have a tensile strength of 400 MPa or higher and the sheath 30 takes the form of the loose jacket, a characteristic impedance of 100±10Ω can be ensured for the communication cable 1 even if the thickness of the insulation coatings 13 of the insulated wires 11 is smaller than 0.25 mm, or further is 0.20 mm or smaller. In this case, the outer diameter of the whole communication cable 1 can be 2.5 mm or smaller.

Further, the communication cable 1 having the loose jacket sheath 30 is lighter in weight per unit length than the filled jacket sheath since the loose jacket configuration requires a smaller amount of material. Weight reduction of the sheath 30 by adopting the loose jacket configuration, together with above-described reduction of the diameter of the conductors 12 and the thickness of the insulation coatings 13, contributes to reduction of weight of the communication cable 1 as a whole and improvement of fuel efficiency of an automobile in which the cable 1 is installed.

Further, the gap G formed between the loose jacket sheath 30 and the insulated wires 11 suppresses fusion between the sheath 30 and the insulation coatings 13 of the insulated wires 11 upon molding of the sheath 30. As a result, the sheath 30 can be removed easily, for example, when a terminal portion of the communication cable 1 is processed. Fusion between the sheath 30 and the insulation coatings 13 tends to be significant particularly when the polymer materials of the sheath 30 and the insulation coatings 13 are of the same kind.

Though the communication cable 1 having the loose jacket sheath 30 may be sensitive to the influence of unintended flection or bending due to the hollow cylinder shape of the sheath 30, the influence is mitigated by the use of the conductors 12 having the tensile strength of 400 MPa or higher.

When there exists a larger gap G between the sheath 30 and the insulated wires 11, the communication cable 1 has a smaller effective dielectric constant (see Formula (1)), and thus a higher characteristic impedance. When the ratio of the area that the gap G occupies (hereafter called outer area ratio) is 8% or more in a cross section of the communication cable 1 substantially orthogonal to the axis of the cable 1 with respect to the total area of the region surrounded by the outer surface of the sheath 30 or, in other words, with respect to the cross-sectional area of the cable 1 including the thickness of the sheath 30, the characteristic impedance of 100±10Ω can be ensured well. This is because a layer of sufficient amount of air exists around the twisted pair 10. The outer area ratio of the gap G is more preferably 15% or more. On the other hand, if the ratio of the area that gap G occupies is too large, positional displacement of the twisted pair 10 inside the sheath 30 and loosening of the twist structure of the twisted pair 10 may occur easily. Those phenomena may lead to fluctuations or temporal changes in transmission characteristics of the communication cable 1 including the characteristic impedance. In view of suppressing the fluctuations and temporal changes, the outer area ratio of the gap G is preferably 30% or less, and more preferably 23% or less.

An index that can be used to define the ratio of the gap G instead of the above-described outer area ratio may be the ratio of the area that the gap G occupies (hereafter called inner area ratio) in the cross section of the communication cable 1 substantially orthogonal to the axis of the cable 1 with respect to the total area of the region surrounded by the inner surface of the sheath 30 or, in other words, with respect to the cross-sectional area of the cable 1 excluding the thickness of the sheath 30. For the same reasons described above for the outer area ratio, the inner area ratio of the gap G is preferably 26% or more, and more preferably 39% or more while it is preferably 56% or less, and more preferably 50% or less. The outer area ratio is more preferable than the inner area ratio to be used as an index to define the size of the gap G for ensuring the sufficient characteristic impedance because the thickness of the sheath 30 has influence on the effective dielectric constant and characteristic impedance of the communication cable 1. Nevertheless, the inner area ratio may also be a good index particularly when the sheath 30 is so thick that the thickness of the sheath 30 has only small influence on the characteristic impedance of the communication cable 1.

The ratio of the gap Gin the cross section of the communication cable 1 may be different depending on the position within one pitch of the twisted pair 10. In such a case, it is preferable that the outer or inner area ratio of the gap G should fall in the above-described preferable range on an average over the length corresponding to one pitch of the twisted pair 10, and it is more preferable that the ratio should fall in the range everywhere over the length corresponding to the one pitch. Alternatively, the ratio of the gap G in this case may be evaluated based on the volume of the gap G in the length corresponding to the one pitch of the twisted pair 10. Specifically, the ratio of the volume that the gap G occupies (hereafter called outer volume ratio) with respect to the volume of the region surrounded by the outer surface of the sheath 30 in the length corresponding to the one pitch of the twisted pair 10 is preferably 7% or more, and more preferably 14% or more. On the other hand, the outer volume ratio is preferably 29% or less, and more preferably 22% or less. Further alternatively, the ratio of the volume that the gap G occupies (hereafter called inner volume ratio) with respect to the volume of the region surrounded by the inner surface of the sheath 30 in the length corresponding to the one pitch of the twisted pair 10 is preferably 25% or more, and more preferably 38% or more. On the other hand, the inner volume ratio is preferably 55% or less, and more preferably 49% or less.

Further, when there exists a larger gap G between the sheath 30 and the insulated wires 11, the effective dielectric constant represented by Formula (1) is smaller, as described above. The effective dielectric constant depends on the size of the gap G as well as on other parameters such as the type of the material of the sheath 30 and the thickness of the sheath 30. When the size of the gap G and the other parameters are set so as to provide the effective dielectric constant of 7.0 or smaller, and more preferably 6.0 or smaller, the characteristic impedance of the communication cable 1 can effectively be increased to as high as 100±10Ω. On the other hand, the effective dielectric constant is preferably 1.5 or larger, and more preferably 2.0 or larger in view of providing manufacturability and reliability of the communication cable 1 and ensuring a certain or larger thickness for insulation coatings 13. The size of the gap G may be controlled by conditions on formation of the sheath 30 by extrusion molding (such as shapes of die and point and extrusion temperature).

As shown in FIG. 1, some portions of the inner surface of the sheath 30 are in contact with the insulated wires 11. If the sheath 30 is strongly adhered to the insulated wires 11 in the portions, the sheath 30 can suppress phenomena such as positional displacement of the twisted pair 10 inside the sheath 30 and loosening of twist structure of the twisted pair 10 by holding the twisted pair 10 fast. The adhesion strength of the sheath 30 to the insulated wires 11 is preferably 4 N or higher, more preferably 7 N or higher, and still more preferably 8 N or higher. Consequently, those phenomena can be suppressed effectively. Further, the line spacing between the two insulated wires 11 can be maintained at a small value, such as substantially 0 mm, and thus fluctuations or temporal changes in transmission characteristics including the characteristic impedance can effectively be suppressed. On the other hand, the adhesion strength is preferably 70 N or lower because if the adhesion strength of the sheath 30 is too high, the processibility of the communication cable 1 may be low. The adhesion of the sheath 30 to the insulated wires 11 may be adjusted depending on the extrusion temperature of a resin material that is extruded around the twisted pair 10 to form the sheath 30. The adhesion strength may be evaluated, for example, by a test in which a 30-mm long portion of the sheath 30 is removed from a terminal end of the communication cable 1 having a length of 150 mm, and then the twisted pair 10 is pulled. The strength of pulling when the twisted pair 10 falls out can be regarded as the adhesion strength.

Further, when the area in which the inner surface of the sheath 30 is in contact with the insulated wires 11 is larger, the phenomena are suppressed better such as positional displacement of the twisted pair 10 inside the sheath 30 and loosening of the twist structure of the twisted pair 10. The phenomena are effectively suppressed when the ratio of the length of portions where the sheath 30 is in contact with the insulated wires 11 (hereafter called contact ratio) with respect to the total length of an inner perimeter of the sheath 30 in the cross section of the communication cable 1 substantially orthogonal to the axis of the cable 1 is preferably 0.5% or more, and more preferably 2.5% or more. On the other hand, the gap G can be surely formed when the contact ratio is 80% or less, and more preferably 50% or less. It is preferable that the contact ratio should fall in the above-described preferable range on an average over the length corresponding to the one pitch of the twisted pair 10, and it is more preferable that the contact ratio should fall in the range everywhere over the length corresponding to the one pitch.

The thickness of the sheath 30 may be set appropriately. For example, the thickness may be 0.20 mm or larger, and more preferably 0.30 mm or larger in view of reducing the influence of noises from outside of the communication cable 1, such as from other cables constituting a wiring harness together with the communication cable 1, and in view of ensuring mechanical properties of the sheath 30 such as wear resistance and impact resistance. On the other hand, the thickness of the sheath 30 may be 1.0 mm or smaller, and more preferably 0.7 mm or smaller, in view of providing a small effective dielectric constant and reducing the diameter of the whole communication cable 1.

Though the loose jacket sheath 30 is more preferable in view of reduction of the diameter of the communication cable 1 as described hitherto, the filled jacket sheath 30' may also be used as shown in FIG. 2, for example, when reduction of the diameter of the cable 1 is not so highly required. The filled jacket sheath 30' attenuates common-mode noises originating from coupling between the twisted pair 10 and the ground potential outside the communication cable 1 more effectively than the loose jacket sheath 30 since the sheath 30' provides larger dielectric loss due to the effect of dielectric thickness. Further, the filled jacket sheath 30' fixes the twisted pair 10 more steadily and suppresses the phenomena better, such as positional displacement of the twisted pair 10 with respect to the sheath 30' and loosening of the twist structure of the twisted pair 10. As a result, fluctuations or temporal changes in transmission characteristics of the communication cable 1 including the characteristic impedance caused by those phenomena are suppressed better. It may be controlled by conditions on formation of the sheath 30/30' by extrusion molding (such as shapes of die and point and extrusion temperature) whether the loose jacket sheath 30 or the filled jacket sheath 30' is formed and how thick the sheath 30/30' is. It should be noted that it is not mandatory for the communication cable 1 to have a sheath 30, but the sheath 30 may be omitted when no problem is caused by the omission of the sheath 30 in protection of the twisted pair 10 and maintenance of the twist structure thereof.

The sheath 30 may be composed of a plurality of layers or of a single layer. The sheath 30 is more preferably composed of a single layer in view of reduction of the diameter and cost of the communication cable 1 by simplification of the configuration. In the above-described embodiment, the dielectric tangent of the sheath is set at 0.0001 or higher. When the sheath 30 is composed of a plurality of layers, at least one of the layers has a dielectric tangent of 0.0001 or higher. It is more preferable an average of the dielectric tangents of the layers weighted by the thickness of the individual layers should be 0.0001 or higher, and it is still more preferable that every layer should have a dielectric tangent of 0.0001 or higher.

A description of specific examples of the copper alloy wires to be used as conductors 12 of the insulated wires 11 in the communication cable 1 according to the above-described embodiment will be provided below.

Copper alloy wires according to a first example has the following ingredients composition:

Fe: 0.05 mass % or more and 2.0 mass % or less;
Ti: 0.02 mass % or more and 1.0 mass % or less;
Mg: 0 mass % or more and 0.6 mass % or less (including a case where Mg is not contained in the alloy); and
a balance being Cu and unavoidable impurities.

The copper alloy wires having the above-described ingredients composition have a very high tensile strength. Particularly when the copper alloy wires contain 0.8 mass % or more of Fe or 0.2 mass % or more of Ti, an especially high tensile strength is achieved. Further, the tensile strength of the wires may be improved when the diameter of the wires is reduced by increasing drawing reduction ratio or when the wires are subjected to a heat treatment after drawn. Thus, the conductors 11 having the tensile strength of 400 MPa or higher can be obtained.

Copper alloy wires according to a second example has the following ingredients composition:

Fe: 0.1 mass % or more and 0.8 mass % or less;
P: 0.03 mass % or more and 0.3 mass % or less;
Sn: 0.1 mass % or more and 0.4 mass % or less; and
a balance being Cu and unavoidable impurities.

The copper alloy wires having the above-described ingredients composition have a very high tensile strength. Particularly when the copper alloy wires contain 0.4 mass % or more of Fe or 0.1 mass % or more of P, an especially high tensile strength is achieved. Further, the tensile strength of the wires may be improved when the diameter of the wires is reduced by increasing drawing reduction ratio or when the wires are subjected to a heat treatment after drawn. Thus, the conductors 11 having the tensile strength of 400 MPa or higher can be obtained.

EXAMPLE

A description will now be specifically provided with reference to examples; however, the present invention is not limited to the examples. For the examples, evaluations were performed in the air at room temperature unless otherwise specified.

[0] Examination Regarding Dielectric Tangent of Sheath

First, relation between a dielectric tangent of a sheath and mode conversion characteristics was examined.

Preparation of Samples

(1) Preparation of Insulating Materials

As materials of sheaths of communication cables and insulation coatings of insulated wires, insulating materials A to D were prepared by mixing of the ingredients shown in Table 1 below. The flame retardant used here was magnesium hydroxide. The antioxidant was a hindered phenol-type antioxidant.

(2) Preparation of Conductor

A conductor to be contained in the insulated wires was prepared. Specifically, an electrolytic copper of a purity of 99.99% or higher and master alloys containing Fe and Ti were charged in a melting pot made of a high-purity carbon, and were vacuum-melted to provide a mixed molten metal containing 1.0 mass % of Fe and 0.4 mass % of Ti. The mixed molten metal was continuously cast into a cast product of φ12.5 mm. The cast product was subjected to extrusion and rolling to have a diameter of φ8 mm, and then was drawn to provide an elemental wire of φ0.165 mm. Seven elemental wires as produced were stranded with a stranding pitch of 14 mm, and then the stranded wire was compressed. Then the compressed wire was subjected to a heat treatment where the temperature of the wire was kept at 500° C. for eight hours. Thus, a conductor having a conductor cross section of 0.13 $mm^2$ and an outer diameter of 0.45 mm was prepared.

Tensile strength and breaking elongation of the copper alloy conductor thus prepared were evaluated in accordance with JIS Z 2241. For the evaluation, the distance between evaluation points was set at 250 mm, and the tensile speed was set at 50 mm/min. According to the result of the evaluation, the copper alloy conductor had a tensile strength of 490 MPa and a breaking elongation of 8%.

(3) Preparation of Insulated Wires

Insulated wires for Samples 1 to 10 were prepared by formation of insulation coatings around the above-prepared copper alloy conductors through extrusion. As the materials of the insulation coatings, insulating material B was used for Samples 1 to 4 while the insulating materials shown in Table 3 were used for Samples 5 to 10, respectively. The thickness of the insulation coatings was 0.20 mm. The eccentricity ratio of the insulated wires was 80%.

(4) Preparation of Communication Cables

Two insulated wires as prepared above were twisted each other with a twist pitch of 24 times of the outer diameter of the insulated wires, to provide twisted pairs. The twisted pairs had the first twist structure (without wrenching). Then, sheaths were formed by extrusion of insulating materials around the prepared twisted pairs.

As the materials of the sheaths, insulating materials selected from insulating materials A to D as shown in Tables 2 and 3 were used for Samples 1 to 4 and Samples 5 to 10, respectively. Thus prepared communication cables of Samples 1 to 4 all had insulation coatings of the insulated wires made of insulating material B, and respectively had sheaths made of insulating materials A to D. Meanwhile, communication cables as Samples 5 to 10 had insulation coatings of the insulated wires and sheaths made of insulating materials B to D in respective combinations.

Here, the sheaths took the form loose jackets having a thickness of 0.4 mm. The gaps between the sheaths and the insulated wires had an outer area ratio of 23%. The adhesion strength of the sheaths to the insulated wires was 15 N. The communication cables as Samples 1 to 4 and Samples 5 to 10 were thus prepared.

Characteristic impedances of the communication cables as Samples 1 to 10 were measured by the open-short method with the use of an LCR meter. It was confirmed that the communication cables as Samples 1 to 10 all had characteristic impedances of 100±10Ω.

Evaluation

First, dielectric tangents of insulating materials A to D were measured. The measurement was performed with the use of an impedance analyzer.

Next, transmission mode conversion characteristics (LCTL) were evaluated for Samples 1 to 4, which had sheaths having different dielectric tangents by being made of different materials. The measurement was performed at a frequency of 50 MHz with the use of a network analyzer.

Further, transmission mode conversion characteristics were evaluated also for Samples 5 to 10 in the same manner, which have sheaths and insulation coatings having different combinations of dielectric tangents by being made of different combinations of materials.

Results

Table 1 shows the measurement results of the dielectric tangents of insulating materials A to D, as well as compositions of the materials.

TABLE 1

| | Ingredient Content [Parts by Mass] | | | | |
|---|---|---|---|---|---|
| Insulating Material | Polypropylene Resin | Flame Retardant | Anti-oxidant | Styrene Elastomer | Dielectric Tangent |
| A | 100 | 20 | 2 | 10 | 0.0001 |
| B | | 60 | | | 0.0002 |
| C | | 120 | | | 0.0006 |
| D | | 180 | | | 0.001 |

Table 1 indicates that a material containing a larger amount of the filler has a higher dielectric tangent.

Next, Table 2 summarizes the measurement results of the transmission conversion characteristics of the communication cables as Samples 1 to 4, having sheaths made of insulating materials A to D, respectively.

TABLE 2

| | Insulation Coating | | Sheath | | Transmission |
|---|---|---|---|---|---|
| Sample No. | Insulating Material | Dielectric Tangent | Insulating Material | Dielectric Tangent | Mode Conversion |
| 1 | B | 0.0002 | A | 0.0001 | 46 |
| 2 | | | B | 0.0002 | 47 |
| 3 | | | C | 0.0006 | 53 |
| 4 | | | D | 0.001 | 56 |

Table 2 indicates that a transmission mode conversion of 46 dB or higher is achieved when the sheath has a dielectric tangent of 0.0001 or higher. Further, the value of transmission mode conversion is higher when the dielectric tangent of the sheath is higher.

Finally, Table 3 summarizes the measurement results of the transmission conversion characteristics of Samples 5 to 10, which have the sheaths and insulation coatings having different combinations of dielectric tangents by being made of different combinations of materials.

TABLE 3

| | Insulation Coating | | Sheath | | Transmission Mode |
|---|---|---|---|---|---|
| Sample No. | Insulating Material | Dielectric Tangent | Insulating Material | Dielectric Tangent | Conversion [dB] |
| 5 | B | 0.0002 | B | 0.0002 | 47 |
| 6 | B | 0.0002 | D | 0.001 | 56 |
| 7 | C | 0.0006 | B | 0.0002 | 44 |
| 8 | C | 0.0006 | D | 0.001 | 53 |

TABLE 3-continued

| Sample No. | Insulation Coating: Insulating Material | Insulation Coating: Dielectric Tangent | Sheath: Insulating Material | Sheath: Dielectric Tangent | Transmission Mode: Conversion [dB] |
|---|---|---|---|---|---|
| 9 | D | 0.001 | B | 0.0002 | 43 |
| 10 | D | 0.001 | D | 0.001 | 49 |

According to the results presented in Table 3, Samples 7 and 9, in which the dielectric tangents of the sheaths are lower than those of the insulation coatings, have values of transmission mode conversion below the criterion at 46 dB. Meanwhile, Samples 5 and 10, in which the dielectric tangents of the sheaths are identical to those of the insulation coatings, have values of transmission mode conversion not lower than 46 dB. Further, Samples 6 and 8, in which the dielectric tangents of the sheaths are higher than those of the insulation coatings, have values of transmission mode conversion above 50 dB. According to comparison between Samples 6 and 8, Sample 6, having larger difference in the dielectric tangent between the sheath and the insulation coatings, has a higher value of transmission mode conversion.

[1] Examination Regarding Tensile Strength of Conductor

Possibility of reduction of the diameter of a communication cable by selection of the tensile strength of conductors was examined.

Preparation of Samples (1) Preparation of Conductors

The copper alloy wires prepared in Examination [0] above was used as conductors for Samples A1 to A5. As described above, the conductors had the conductor cross section of 0.13 $mm^2$, outer diameter of 0.45 mm, tensile strength of 490 MPa, and breaking elongation of 8%.

As conductors for Samples A6 to A8, a conventional strand wire made of pure copper was used. The tensile strength, breaking elongation, conductor cross section, and outer diameter of the conductors were measured in the same manner as described above, and are shown in Table 4. The conductor cross section and outer diameter adopted for the conductors were those which can be assumed to be substantial lower limits for a pure copper electric wire defined by the limited strength of the conductors.

(2) Preparation of Insulated Wires

Insulated wires were prepared by formation of insulation coatings made of a polyethylene resin around the above-prepared copper alloy and pure copper conductors through extrusion. The thicknesses of the insulation coatings for the samples were as shown in Table 4. The eccentricity ratio of the insulated wires was 80%. The polyethylene resin used had a dielectric tangent of 0.0002.

(3) Preparation of Communication Cables

Two insulated wires as prepared above were twisted each other with a twist pitch of 25 mm, to provide twisted pairs. The twisted pairs had the first twist structure (without wrenching). Then, sheaths were formed by extrusion of a polyethylene resin around the prepared twisted pairs. The polyethylene resin used had a dielectric tangent of 0.0002. The sheaths took the form of loose jackets having a thickness of 0.4 mm. The gaps between the sheaths and the insulated wires had an outer area ratio of 23%. The adhesion strength of the sheaths to the insulated wires was 15 N. Thus, the communication cables as Samples A1 to A8 were prepared.

Evaluation (Finished Outer Diameter)

Outer diameters of the prepared communication cables were measured for evaluation of whether the diameters of the cables were successfully reduced.

(Characteristic Impedance)

Characteristic impedances of the prepared communication cables were measured. The measurement was performed by the open-short method with the use of an LCR meter.

Results

Table 4 shows the configurations and evaluation results of the communication cables as Samples A1 to A8.

TABLE 4

| Sample No. | Insulated Wire: Conductor: Material | Conductor: Tensile Strength [MPa] | Conductor: Elongation [%] | Conductor: Cross-sectional Area [$mm^2$] | Conductor: Outer Diameter [mm] | Thickness of Insulation Coating [mm] | Finished: Outer Diameter [mm] | Finished: Outer Diameter [mm] | Characteristic Impedance [Ω] |
|---|---|---|---|---|---|---|---|---|---|
| A1 | Copper Alloy | 490 | 8 | 0.13 | 0.45 | 0.30 | 1.05 | 2.9 | 110 |
| A2 | | | | | | 0.25 | 0.95 | 2.7 | 102 |
| A3 | | | | | | 0.20 | 0.85 | 2.5 | 96 |
| A4 | | | | | | 0.18 | 0.81 | 2.4 | 91 |
| A5 | Copper Alloy | 490 | 8 | 0.13 | 0.45 | 0.15 | 0.75 | 2.3 | 86 |
| A6 | Pure Copper | 220 | 24 | 0.22 | 0.55 | 0.30 | 1.15 | 3.1 | 97 |
| A7 | | | | | | 0.25 | 1.05 | 2.9 | 89 |
| A8 | | | | | | 0.20 | 0.95 | 2.7 | 80 |

According to the evaluation results shown in Table 4, Samples A1 to A3, which contain the copper alloy conductors and have the conductor cross-sectional area smaller than 0.22 $mm^2$, have higher characteristic impedances than Samples A6 to A8, which contain the pure copper conductors and have the conductor cross-sectional area of 0.22 $mm^2$, though the sheaths of Samples A1 to A3 have the same thicknesses as those of Samples A6 to A8, respectively. Samples A1 to A3 all have characteristic impedances in the range of 100±10Ω, which is required for Ethernet communication, while Samples A7 and A8 have particularly low impedances out of the range of 100±10Ω.

The above-observed tendency in the characteristic impedances can be interpreted as a result of the smaller diameter of the copper alloy conductors and the smaller distance therebetween than those of the pure copper conductors. Consequently, the copper alloy conductors can have the small thickness of the insulation coatings smaller than 0.30 mm while ensuring the characteristic impedances of 100±10Ω; the thickness can be reduced to 0.18 mm at the minimum. Reduction of the thickness of the insulation coatings, as well as reduction of the diameter of the conductors itself, thus serves to reduce the finished outer diameter of the communication cable.

For example, Sample A3, containing the copper alloy conductors, and Sample A6, containing the pure copper conductors, have almost the same characteristic impedance values. When the finished outer diameters of the samples are compared, however, the communication cable as Sample A3, containing the copper alloy conductors, has the 20% smaller finished diameter since the conductors have smaller diameters.

Meanwhile, when the insulation coatings formed around the copper alloy conductors are too thin, as in the case of Sample A5, the characteristic impedance may be out of the range of 100±10Ω. Thus, a characteristic impedance of 100±10Ω can be achieved when insulation coatings having an appropriate thickness are formed around copper alloy conductors having a reduced diameter.

[2] Examination Regarding Type of Sheath

Next, possibility of reduction of the diameter of the communication cable depending on the type of the sheath was examined.

Preparation of Samples

Communication cables were prepared in the same manner as Samples A1 to A4 in Examination [1] described above. The eccentricity ratio of the insulated wires was 80%. The twisted pairs had the first twist structure (without wrenching). Here, two types of samples were prepared that have sheaths taking the form of loose jackets as shown in FIG. 1 and filled jackets as shown in FIG. 2, respectively. For the both types of samples, the sheaths were formed of a polypropylene resin (having a dielectric tangent of 0.0001). The thickness of the sheaths was controlled by the shapes of die and point used; the thickness was 0.4 mm for the loose jacket type, and was 0.5 mm for the filled jacket type at the thinnest part. The gaps between the loose jacket sheaths and the insulated wires had an outer area ratio of 23%. The adhesion strength of the sheaths to the insulated wires was 15 N. Several samples containing insulated wires having different thicknesses of insulation coatings were prepared as samples having loose and filled jacket sheaths, respectively.

Evaluation

Characteristic impedances of the samples prepared above were measured in the same manner as in Examination [1] described above. Further, outer diameters (i.e., finished outer diameters) and masses per unit length of the communication cables were measured for some of the samples.

Further, transmission characteristics IL, RL, LCTL, and LCL were measured for some of the samples with the use of a network analyzer.

Results

Figure 4:
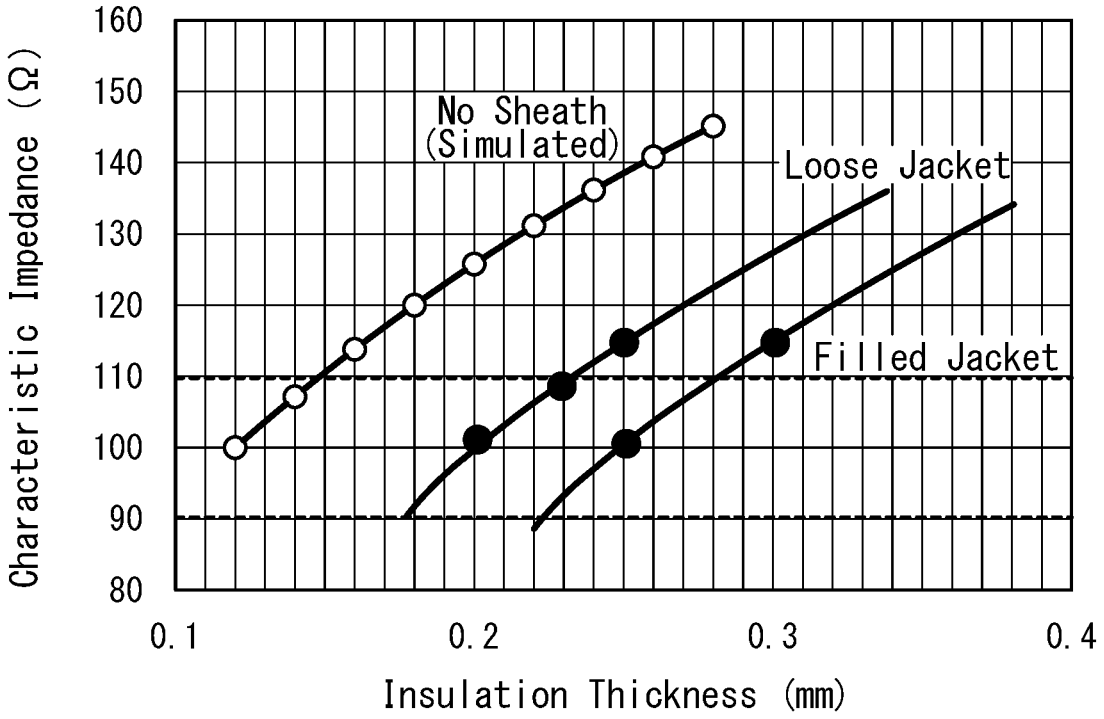
FIG. 4 shows relation between the thickness of insulation coatings of insulated wires and the characteristic impedance in the case where the sheath takes the form of a loose or filled jacket. A simulation result in the case having no sheath is also shown in the figure.

FIG. 4 shows plots of relation between the thickness of the insulation coatings of the insulated wires (i.e., insulation thickness) and the characteristic impedance measured for the cables having the loose and filled jacket sheaths, respectively. FIG. 4 also shows a simulation result of the relation between the insulation thickness and the characteristic impedance for a case having no sheath. The simulation result was obtained based on Formula (1), which is known as a theoretical formula representing a characteristic impedance of a communication cable having a twisted pair, (where $\varepsilon_{eff}$=2.6). Approximation curves based on Formula (1) are also shown for the measurement results in the cases having the two types of sheaths. The broken lines in FIG. 4 show a range in which the characteristic impedance is 100±10Ω.

According to the results shown in FIG. 4, the characteristic impedances of the communication cables having the same insulation thickness are decreased by the presence of the sheaths, corresponding to increase of the effective dielectric constant; however, the loose jacket sheath less decreases the characteristic impedance and provides a higher value of characteristic impedance than the filled jacket sheath. In other words, the insulation thickness required to achieve a certain characteristic impedance is smaller in the case of the loose jacket sheath.

According to FIG. 4, the characteristic impedance of b 100Ω is observed when the insulation thickness is 0.20 mm for the loose jacket and when the thickness is 0.25 mm for the filled jacket. For these cases, insulation thicknesses and outer diameters and masses of the communication cables are summarized in Table 5 below.

TABLE 5

| | Sample B1 | Sample B2 |
|---|---|---|
| Type of Jacket | Loose Jacket | Filled Jacket |
| Insulation Thickness | 0.20 mm | 0.25 mm |
| Outer Diameter | 2.5 mm | 2.7 mm |
| Mass | 7.3 g/m | 10.0 g/m |

As shown in Table 5, the loose jacket sheath provides 25% smaller insulation thickness, 7.4% smaller outer diameter of the communication cable, and 27% smaller mass of the communication cable, than the filled jacket sheath. Thus, it is confirmed that a communication cable having a loose jacket sheath has a sufficiently high characteristic impedance even containing insulated wires having a smaller insulation thickness in a twisted pair, whereby the outer diameter and mass of the whole communication cable are reduced.

Further, the transmission characteristics of the communication cable having the loose jacket sheath and the insulation thickness of 0.20 mm were evaluated. It is confirmed based on the evaluation results that criteria IL≤0.68 dB/m (66 MHz), RL≥20.0 dB (20 MHz), LCTL≥46.0 dB (50 MHz), and LCL≥46.0 dB (50 MHz) are all satisfied.

[3] Examination Regarding Size of Gap

Next, relation between the size of the gap between the sheath and the insulated wires and the characteristic impedance was examined.

Preparation of Samples

Communication cables as Samples C1 to C6 were prepared in the same manner as Samples A1 to A4 in Examination [1] described above. Here, the sheaths took the form of loose jackets made of a polypropylene resin (having a dielectric tangent of 0.0001). The size of the gaps between the sheaths and the insulated wires was varied by selection of the shapes of the die and point. In the insulated wires, the conductor cross-sectional area of the insulated wires was 0.13 $mm^2$, and the thickness of the insulation coatings was 0.20 mm. The thickness of the sheaths was 0.40 mm. The eccentricity ratio was 80%. The adhesion strength of the sheaths to the insulated wires was 15 N. The twisted pairs had the first twist structure (without wrenching).

Evaluation

Sizes of the gaps in the samples prepared above were measured. For the measurement, the sample cables were embedded and fixed in an acrylic resin, and then were cut, to provide cross sections. The size of each gap was measured in the cross section as the ratio with respect to the entire cross-sectional area. The obtained sizes of the gaps are shown in Table 6 in the form of outer and inner area ratios defined above. Further, characteristic impedances of the samples were measured in the same manner as in Examination [1] described above. The values of characteristic impedance shown in Table 6 each have certain ranges because the values fluctuated during the measurement.

Results

Relation between the size of the gap and the characteristic impedance is summarized in Table 6.

TABLE 6

| Sample No. | Ratio of Gap: Outer Area Ratio [%] | Ratio of Gap: Inner Area Ratio [%] | Characteristic Impedance [Ω] |
|---|---|---|---|
| C1 | 4 | 15 | 86-87 |
| C2 | 8 | 26 | 90-92 |
| C3 | 15 | 39 | 95-97 |
| C4 | 23 | 50 | 99-101 |
| C5 | 30 | 56 | 103-106 |
| C6 | 40 | 63 | 108-113 |

As shown in Table 6, Samples C2 to C5, which have the gaps of the outer area ratios of 8% or more and 30% or less, exhibit the characteristic impedances of 100±10Ω stably. Meanwhile, Sample C1, which has the gap of the outer area ratio less than 8%, has the characteristic impedance lower than the range of 100±10Ω since the effective dielectric constant is too large because of the smallness of the gap. Sample C6, which has the gap of the outer area ratio more than 30%, has the characteristic impedance exceeding the range of 100±10Ω. It is construed that the median value of the characteristic impedance of Sample C6 is high because the gap is too large, and the fluctuations in the characteristic impedance is large because the large gap easily allows variation of the position of the twisted pair inside the sheath or loosening of the twist structure thereof.

[4] Examination Regarding Adhesion Strength of Sheath

Next, relation between the adhesion strength of the sheath to the insulated wires and the temporal change of the characteristic impedance was examined.

Preparation of Samples

Communication cables as Samples D1 to D4 were prepared in the same manner as Samples A1 to A4 in Examination [1] described above. The sheaths took the form of loose jackets made of a polypropylene resin (having a dielectric tangent of 0.0001). The adhesion strength of the sheaths to the insulated wires was varied as shown in Table 7. Here, the adhesion strength was varied by control of the extrusion temperature of the resin material. The gaps between the sheaths and the insulated wires had an outer area ratio of 23%. In the insulated wires, the conductor cross-sectional area was 0.13 $mm^2$, and the thickness of the insulation coatings was 0.20 mm. The thickness of the sheaths was 0.40 mm. The eccentricity ratio of the insulated wires was 80%. The twisted pairs had the first twist structure (without wrenching). The twist pitch was 8 times of the outer diameter of the insulated wires.

Evaluation

Adhesion strengths of the sheaths were measured for the samples prepared above. Adhesion strength of each sheath was evaluated by a test in which a 30-mm long portion of the sheath was removed from a terminal end of the sample communication cable having a length of 150 mm, and then the twisted pair was pulled. The strength of pulling when the twisted pair fell out was recorded as the adhesion strength. Further, changes of the characteristic impedance of the samples were measured in a condition simulating a long-term use. Specifically, the sample communication cables were each bent 200 times along a mandrel having an outer diameter of φ25 mm at an angle of 90°. Then, characteristic impedance was measured at the bent portions, and the change from the value before the bending was recorded.

Results

Relation between the adhesion strength of the sheath and the characteristic impedance is summarized in Table 7.

TABLE 7

| Sample No. | Adhesion Strength of Sheath [N] | Change of Characteristic Impedance |
|---|---|---|
| D1 | 15 | No Change |
| D2 | 7 | Increase of 3Ω |
| D3 | 4 | Increase of 3Ω |
| D4 | 2 | Increase of 7Ω |

According to the results shown in Table 7, Samples D1 to D3, in which the sheaths have the adhesion strengths of 4 N or higher, exhibit small changes of 3Ω or smaller in the characteristic impedances. These results indicate that the samples are not susceptible to the influence of the long-term use simulated by the bending with the use of the mandrel.

Meanwhile, Sample D4, in which the sheath has the adhesion strength lower than 4 N, exhibits a large change of 7Ω in the characteristic impedance.

[5] Examination Regarding Thickness of Sheath

Next, relation between the thickness of the sheath and the influence from the outside on the transmission characteristics was examined.

Preparation of Samples

Communication cables as Samples E1 to E6 were prepared in the same manner as Samples A1 to A4 in Examination [1] described above. The sheaths took the form of loose jackets made of a polypropylene resin (having a dielectric tangent of 0.0001). For Samples E2 to E6, the thickness of the sheaths was varied as shown in Table 8. For Sample E1, no sheath was formed. The gaps between the sheaths and the insulated wires had an outer area ratio of 23%. The adhesion strength of the sheaths was 15 N. In the insulated wires, the conductor cross-sectional area was 0.13 $mm^2$, and the thickness of the insulation coatings was 0.20 mm. The eccentricity ratio of the insulated wires was 80%. The twisted pairs had the first twist structure (without wrenching). The twist pitch was 24 times of the outer diameter of the insulated wires.

Evaluation

For the sample communication cables prepared above, changes in the characteristic impedance by the influence of other cables were evaluated. Specifically, characteristic impedances of the sample communication cables were each measured in an independent state. Further, characteristic impedances of the communication cables were each measured also in a state held with other cables. Here, the state held with other cables denotes a state where a sample cable is surrounded by six other cables (i.e., six PVC cables having an outer diameter of 2.6 mm) that are arranged approximately centrosymmetrically around the sample cable in contact with the outer surface of the sample cable, and the sample cable and the six other cables are together fixed by a PVC tape wound around them. Then, change of the characteristic impedance of each communication cable in the state held with other cables with respect to the independent state was recorded.

Results

Relation between the thickness of the sheath and the change of the characteristic impedance is summarized in Table 8.

TABLE 8

| Sample No. | Thickness of Sheath [mm] | Change of Characteristic Impedance |
|---|---|---|
| E1 | 0 (No Sheath) | Decrease of 10Ω |
| E2 | 0.10 | Decrease of 8Ω |
| E3 | 0.20 | Decrease of 4Ω |
| E4 | 0.30 | Decrease of 3Ω |
| E5 | 0.40 | Decrease of 3Ω |
| E6 | 0.50 | Decrease of 2Ω |

According to the results shown in Table 8, for Samples E3 to E6, which contain sheaths having the thickness of 0.20 mm or larger, the changes of the characteristic impedance by the influence of other cables are suppressed to 4Ω or lower. Meanwhile, for Sample E1, which does not contain a sheath, and Sample E2, which contains a sheath having a thickness smaller than 0.20 mm, the changes of the characteristic impedances are as high as 8Ω or higher. It is preferable that a change of a characteristic impedance of a communication cable of this type should be suppressed to 5Ω or lower when the communication cable is used in the proximity of another cable in an automobile, for example, in the form of a wiring harness.

[6] Examination Regarding Eccentricity Ratio of Insulated Wires

Next, relation between the eccentricity ratio of the insulated wires and the transmission characteristics was examined.

Preparation of Samples

Communication cables as Samples F1 to F6 were prepared in the same manner as Samples A1 to A4 in Examination [1] described above. Here, the eccentricity ratio of the insulated wires was varied as shown in Table 9 by control of the conditions for formation of the insulation coatings. In the insulated wires, the conductor cross-sectional area was 0.13 $mm^2$, and the thickness of the insulation coatings was 0.20 mm (on average). The sheaths took the form of loose jackets made of a polypropylene resin (having a dielectric tangent of 0.0001). The thickness of the sheaths was 0.40 mm. The gaps between the sheaths and the insulated wires had an outer area ratio of 23%. The adhesion strength of the sheaths was 15 N. The twisted pairs had the first twist structure (without wrenching). The twist pitch was 24 times of the outer diameter of the insulated wires.

Evaluation

Transmission mode conversion characteristics (LCTL) and reflection mode transmission characteristics (LCL) of the sample communication cables prepared above were measured in the same manner as in Examination [2] described above. The measurement was performed in a frequency range of 1 to 50 MHz.

Results

Table 9 shows the eccentricities and the measurement results of the mode conversion characteristics. The values of the mode conversion characteristics shown in the table each indicate the minimum absolute values in the range of 1 to 50 MHz.

TABLE 9

| Sample No. | Eccentricity Ratio [%] | Transmission Mode conversion [dB] | Reflection Mode Conversion [dB] |
|---|---|---|---|
| F1 | 60 | 47 | 45 |
| F2 | 65 | 49 | 49 |
| F3 | 70 | 52 | 54 |
| F4 | 75 | 57 | 55 |
| F5 | 80 | 59 | 57 |
| F6 | 85 | 58 | 58 |

According to Table 9, in the cases of Samples F2 to F6, which have the eccentricity ratios of 65% or higher, the transmission and reflection mode conversions both satisfy the criteria of 46 dB or higher. Meanwhile, in the case of Sample F1, which has the eccentricity ratio of 60%, either the transmission or reflection mode conversion does not satisfy the criteria.

[7] Examination Regarding Twist Pitch of Twisted Pair

Next, relation between the twist pitch of the twisted pair and the temporal change of characteristic impedance was examined.

Preparation of Samples

Communication cables as Samples G1 to G4 were prepared in the same manner as Samples D1 to D4 in Examination [4] described above. Here, the twist pitch of the twisted pairs was varied as shown in Table 10. The adhesion strength of the sheaths to the insulated wires was 70 N.

Evaluation

Changes of the characteristic impedance by bending with the use of a mandrel were evaluated for the samples prepared above in the same manner as in Examination [4].

Results

Relation between the twist pitch of the twisted pair and the change of the characteristic impedance is summarized in Table 10. In Table 10, the twist pitches are shown as values based on the outer diameter of the insulated wires (of 0.85 mm): i.e., the values indicate how many times of the outer diameter of the insulated wires the twist pitch is.

TABLE 10

| Sample No. | Twist Pitch [Times] | Change of Characteristic Impedance |
|---|---|---|
| G1 | 15 | No Change |
| G2 | 30 | Increase of 3Ω |
| G3 | 45 | Increase of 4Ω |
| G4 | 50 | Increase of 8Ω |

According to the results shown in Table 10, the changes of the characteristic impedance in the cases of Samples G1 to G3, which have the twist pitches of 45 times of the outer diameter of the insulated wires or smaller, are suppressed to 4Ω or smaller. Meanwhile, the change of the characteristic impedance of Sample G4, which has the twist pitch larger than 45 times of the outer diameter of the insulated wires, reaches 8Ω.

[8] Examination Regarding Twist Structure of Twisted Pair

Next, relation between the type of twist structure of the twisted pair and fluctuations in the characteristic impedance was examined.

Preparation of Samples

Communication cables as Samples H1 and H2 were prepared in the same manner as Samples D1 to D4 in Examination [4] described above. Here, the first twist structure (without wrenching) described above was adopted for Sample H1 while the second twist structure (with wrenching) was adopted for Sample H2. The twist pitches of the twisted pairs in both samples were 20 times of the outer diameter of the insulated wires. The adhesion strength of the sheaths to the insulated wires was 30 N.

Evaluation

Characteristic impedances of the samples prepared above were measured. The measurement was performed three times for each sample, and variation range of the characteristic impedance in the three times measurement was recorded.

Results

Table 11 shows the relation between the type of the twist structure and the variation range of the characteristic impedance.

TABLE 11

| Sample No. | Twist Structure | Variation Range of Characteristic Impedance |
|---|---|---|
| H1 | 1st (Without Wrenching) | 3Ω |
| H2 | 2nd (With Wrenching) | 14Ω |

The results shown in Table 11 indicate that the variation range of the characteristic impedance of Sample H1, in which the insulated wires are not wrenched, is smaller. This is interpreted as because influence of variation in line spacing, which may be caused by the wrenching, is avoided.

The foregoing description of the preferred embodiment has been presented for purposes of illustration and description; however, it is not intended to be exhaustive or to limit the present invention to the precise form disclosed, and modifications and variations are possible as long as they do not deviate from the principles of the present invention.

Further, as described above, the sheath that covers the twisted pair does not necessarily take the form of a loose jacket, but may take the form of a filled jacket, depending on how much the diameter of the communication cable has to be reduced. The communication cable may have a shield inside the sheath. The sheath may be omitted from the communication cable. In short, the communication cable may be one containing a twisted pair comprising a pair of insulated wires twisted with each other, each of the insulated wire comprising a conductor that has a tensile strength of 400 MPa or higher and an insulation coating that covers the conductor, the communication cable having a characteristic impedance of 100±10Ω. In embodiments of the communication cable, preferable configurations described above may be applied to the elements of the communication cable, such as the material, thickness, and dielectric tangent of the insulation coatings; the ingredients composition, breaking elongation, conductor resistance of the conductors; the outer diameter and eccentricity of the insulated wires; the twist structure and twist pitch of the twisted pair; the material, thickness, adhesion strength, and dielectric tangent of the sheath; and the outer diameter and breaking strength of the communication cable. Any of the above-described preferable configurations applicable to the elements of the communication cable can be appropriately combined with the configuration of a communication cable containing a twisted pair comprising a pair of insulated wires twisted with each other, each of the insulated wire comprising a conductor that has a tensile strength of 400 MPa or higher and an insulation coating that covers the conductor, the communication cable having a characteristic impedance of 100±10Ω. The communication cable produced by the combination would have a reduced diameter while simultaneously ensuring a required magnitude of characteristic impedance, and further would possess properties imparted by the respective configurations applied to the cable.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

DESCRIPTION OF REFERENCE NUMERALS

1 Communication cable
10 Twisted pair
11 Insulated wire
12 Conductor
13 Insulation coating
30, 30' Sheath

The invention claimed is:

1. A communication cable, comprising:
- a single twisted pair consisting of one pair of insulated wires twisted with each other, each of the insulated wires comprising:
  - a conductor that has a tensile strength of 400 MPa or higher; and
  - an insulation coating that covers the conductor;
- an insulated sheath that covers the single twisted pair; and
- a gap between an inner surface of the insulated sheath and the insulated wires constituting the single twisted pair, the communication cable having a characteristic impedance of 100±10 Ω;
- each of the insulated wires contacts the inner surface of the insulated sheath and also contacts an outer surface of the other one of the insulated wires of the single twisted pair;
- a total area of the gap occupies 30% or less of an area of a region surrounded by an outer surface of the insulated sheath in a section of the communication cable crossing an axis of the cable; and
- the insulated sheath is a loose jacket that directly surrounds the single twisted pair and is without a shield made of conductive material located on either an outer surface or an inner surface of the insulated sheath.

2. The communication cable of claim 1, wherein the single twisted pair has a twist pitch of 45 times of an outer diameter of each of the insulated wires or smaller.

3. The communication cable of claim 1, wherein the single twisted pair has a twist pitch of 26 times of an outer diameter of each of the insulated wires or larger.

4. The communication cable of claim 1, wherein each of the insulated wires has an outer diameter of 0.95 mm or smaller.

5. The communication cable of claim 1, wherein each of the insulated wires has an eccentricity ratio of 65% or higher, the eccentricity ratio is calculated as ((a smallest insulation thickness/a largest insulation thickness)×100%).

6. The communication cable of claim 1, wherein each of the insulated wires is not wrenched about a twist axis of the insulated wire so that along at least a portion of the insulated wire, with respect to its own axis, the insulated wire does not change its relative up-down or left-right orientation along the twist axis.

7. A communication cable, comprising:
- a single twisted pair consisting of one pair of insulated wires twisted with each other, each of the insulated wires comprising:
  - a conductor that has a tensile strength of 400 MPa or higher; and
  - an insulation coating that covers the conductor;
- an insulated sheath that covers the single twisted pair; and
- a gap between an inner surface of the insulated sheath and the insulated wires constituting the single twisted pair, the communication cable having a characteristic impedance of 100±10 Ω;
- each of the insulated wires contacts the inner surface of the insulated sheath and also contacts an outer surface of the other one of the insulated wires of the single twisted pair;
- a total area of the gap occupies 30% or less of an area of a region surrounded by an outer surface of the insulated sheath in a section of the communication cable crossing an axis of the cable; and
- each of the insulated wires has a line length, a difference between the two line lengths of the pair of insulated wires (line length difference) in 1 m of the single twisted pair is 3 mm or smaller.

8. The communication cable of claim 1, wherein the conductor of each of the insulated wires has a conductor resistance of 150 mΩ/m or higher and 210 mΩ/m or lower.

9. The communication cable of claim 1, wherein the conductor of each of the insulated wires has a breaking elongation of 7% or higher.

10. The communication cable of claim 1, wherein the conductor of each of the insulated wires has an outer diameter of 0.45 mm or smaller.

11. The communication cable of claim 1, wherein the conductor of each of the insulated wires has a cross-sectional area of 0.08 $mm^2$ or larger and 0.22 $mm^2$ or smaller.

12. The communication cable of claim 1, wherein the conductor of each of the insulated wires has a plurality of elemental wires stranded together that include one or more types of elemental wires, at least one of the one or more types of elemental wires is made of a copper alloy.

13. The communication cable of claim 1, wherein the conductor of each of the insulated wires is made of a first copper alloy or a second copper alloy, the first copper alloy comprises:

0.05 mass % or more and 2.0 mass % or less of Fe;
0.02 mass % or more and 1.0 mass % or less of Ti;
0 mass % or more and 0.6 mass % or less of Mg; and
a balance being Cu and unavoidable impurities,
the second copper alloy comprises:
0.1 mass % or more and 0.8 mass % or less of Fe;
0.03 mass % or more and 0.3 mass % or less of P;
0.1 mass % or more and 0.4 mass % or less of Sn; and
a balance being Cu and unavoidable impurities.

14. The communication cable of claim 1, wherein the insulation coating of each of the insulated wires has a dielectric tangent of 0.001 or lower when measured at a frequency in a range of 1 to 50 MHz, in air, and at room temperature.

15. The communication cable of claim 1, wherein the insulation coating of each of the insulated wires has a thickness of 0.15 mm or larger and 0.30 mm or smaller.

16. The communication cable of claim 1, wherein the insulated sheath is made of an insulating material having a dielectric tangent of 0.0001 or higher when measured at a frequency in a range of 1 to 50 MHz, in air, and at room temperature.

17. The communication cable of claim 16, wherein the dielectric tangent of the insulated sheath is higher than a dielectric tangent of the insulation coating of each of the insulated wires when measured at a frequency in a range of 1 to 50 MHz, in air, and at room temperature.

18. The communication cable of claim 1, wherein the insulated sheath has an adhesion strength of 4 N or higher to the insulated wires.

19. The communication cable of claim 1, wherein the insulated sheath has a thickness of 0.20 mm or larger and 1.0 mm or smaller.

20. The communication cable of claim 1, wherein the insulated sheath is a loose jacket and directly surrounds the single twisted pair without a shield made of conductive material or any other member located between the insulated sheath and the single twisted pair.

21. The communication cable of claim 1, wherein the total area of the gap occupies 8% or more of the area of the region surrounded by the outer surface of the insulated sheath in the section of the communication cable crossing the axis of the cable.

22. The communication cable of claim 1, wherein the total area of the gap occupies 26% or more of an area of a region surrounded by an inner surface of the insulated sheath in a section of the communication cable crossing the axis of the cable.

23. The communication cable of claim 1, wherein the communication cable has a breaking strength of 100 N or higher.

24. The communication cable of claim 1, wherein the communication cable has a transmission mode conversion of 46 dB or higher at a frequency of 50 MHz.

* * * * *